US006853342B2

(12) United States Patent
Podger

(10) Patent No.: US 6,853,342 B2
(45) Date of Patent: Feb. 8, 2005

(54) MULTILOOP ANTENNA ELEMENTS

(76) Inventor: James Stanley Podger, 55 Gradwell Dr., Toronto (CA), M1M 2N1

( * ) Notice: Subject to any disclaimer, the term of this patent is extended or adjusted under 35 U.S.C. 154(b) by 53 days.

(21) Appl. No.: 10/216,769

(22) Filed: Aug. 13, 2002

(65) Prior Publication Data

US 2003/0234744 A1 Dec. 25, 2003

(30) Foreign Application Priority Data

Jun. 20, 2002 (CA) ..... 2389791

(51) Int. Cl.[7] ..... H01Q 11/12
(52) U.S. Cl. ..... 343/742; 343/867; 343/792.5
(58) Field of Search ..... 343/741, 742, 343/866, 867, 726, 810, 815, 818, 792.5, 797

(56) References Cited

U.S. PATENT DOCUMENTS

| | | | | | |
|---|---|---|---|---|---|
| 2,324,462 | A | * | 7/1943 | Leeds et al. | 343/742 |
| 3,210,767 | A | | 10/1965 | Isbell | |
| 5,663,738 | A | * | 9/1997 | Mueller | 343/742 |
| 5,805,114 | A | | 9/1998 | Podger | |
| 5,966,100 | A | | 10/1999 | Podger | |
| 5,969,687 | A | * | 10/1999 | Podger | 343/742 |
| 5,995,060 | A | | 11/1999 | Podger | |
| 6,020,857 | A | * | 2/2000 | Podger | 343/742 |
| 6,255,998 | B1 | | 7/2001 | Podger | |
| 6,333,717 | B1 | | 12/2001 | Podger | |
| 6,469,674 | B1 | * | 10/2002 | Podger | 343/742 |

OTHER PUBLICATIONS

Kraus, John D., "A Small But Effective 'Flat Top' Beam," *Radio*, Mar. 1937, pp. 56–58, U. S. A.
Podger, J. S., Analysis Results, *Quadruple Delta*.
Podger, J. S. Analysis Results, *Expanded Quadruple Delta*.
Podger, J. S., Analysis Results, *Sextuple Delta With Dual Crossing Conductors*.
Podger, J. S. Analysis Results, *Sextuple Delta With Single Crossing Conductors*.
Podger, J. S., Analysis Results, *Expanded Sextuple Delta With Dual Crossing Conductors*.
Podger, J. S., Analysis Results, *Expanded Sextuple Delta With Single Crossing Conductors*.
Podger, J. S., Analysis Results, *Quadruple Lemniscate*.
Podger, J. S. Analysis Results, *Octuple Delta With Dual Crossing Conductors*.
Podger, J. S., Analysis Results, *Simulated Quadruple Lemniscate*.
Podger, J. S., Analysis Results, *Octuple Delta With Single Crossing Conductors*.
Podger, J. S., Analysis Results, *Expanded Octuple Delta With Dual Crossing Conductors*, no date.
Podger, J. S., Analysis Results, *Expanded Octuple Delta With Single Crossing Conductors*, no date.
Podger, J. S., Analysis Results, *Strengthened Expanded Octuple Delta*, no date.

* cited by examiner

*Primary Examiner*—Tan Ho

(57) ABSTRACT

Antenna elements that have at least three pairs of coplanar and aligned conducting loops, of approximately one-wavelength to two-wavelength perimeters, that have shapes such that there are corners at the centers and smooth curves or straight lines at the outer edges of each pair of loops. Where the loops of adjacent pairs of loops approach each other, they are connected. Various applications of these antenna elements also are disclosed.

69 Claims, 14 Drawing Sheets

MULTILOOP ANTENNA ELEMENTS

This is the U.S. version of Canadian Patent Application 2,389,791.

FIELD OF THE INVENTION

This invention relates to antenna elements, specifically antenna elements that are combinations of at least three pairs of one-wavelength to two-wavelength loops. Such antenna elements can be used alone or in combinations to serve many antenna needs. One object of the invention is to achieve a superior transmitting or receiving ability in some desired direction. Particularly, an object is to enhance that ability at elevation angles close to the horizon. Another object is to decrease the transmitting and receiving ability in undesired directions. Yet another object is to produce antennas that operate satisfactorily over greater ranges of frequencies.

SUMMARY OF THE INVENTION

Previous disclosures have shown that it is advantageous to use pairs of loops that have corners in the center of the pairs and relatively smooth curves at the outer ends of the pairs. The use of both triangular loops and loops shaped like the mathematical curve called a lemniscate have been disclosed in combinations of up to two pairs of loops. The present disclosure shows that it is advantageous to use three or more pairs of loops.

LIST OF DRAWINGS

The background of this invention, as well as the objects and advantages of the invention will be apparent from the following description and appended drawings, wherein.

PRIOR ART

Prior Art—Loop Antennas

The development of antenna elements based on loops of conductors having perimeters of one to two wavelengths has recently progressed from older shapes, such as squares, diamonds and circles, to combinations of triangles, such as in the applicant's U.S. Pat. No. 5,966,100, entitled Quadruple-Delta Antenna Structure, and U.S. Pat. No. 5,805,114, entitled Expanded Quadruple-Delta Antenna Structure. Some convenient methods invented for strengthening such antennas elements were disclosed in the applicant's U.S. Pat. No. 5,995,060, entitled Strengthened Double Delta Antenna Structure, and U.S. Pat. No. 6,333,717, entitled Diagonal Supporting Conductors for Loop Antennas. In addition, the advantages of loops having the shape of the mathematical curve called a lemniscate were disclosed in the applicant's U.S. Pat. No. 6,255,998, entitled Lemniscate Antenna Element.

Figure 2:
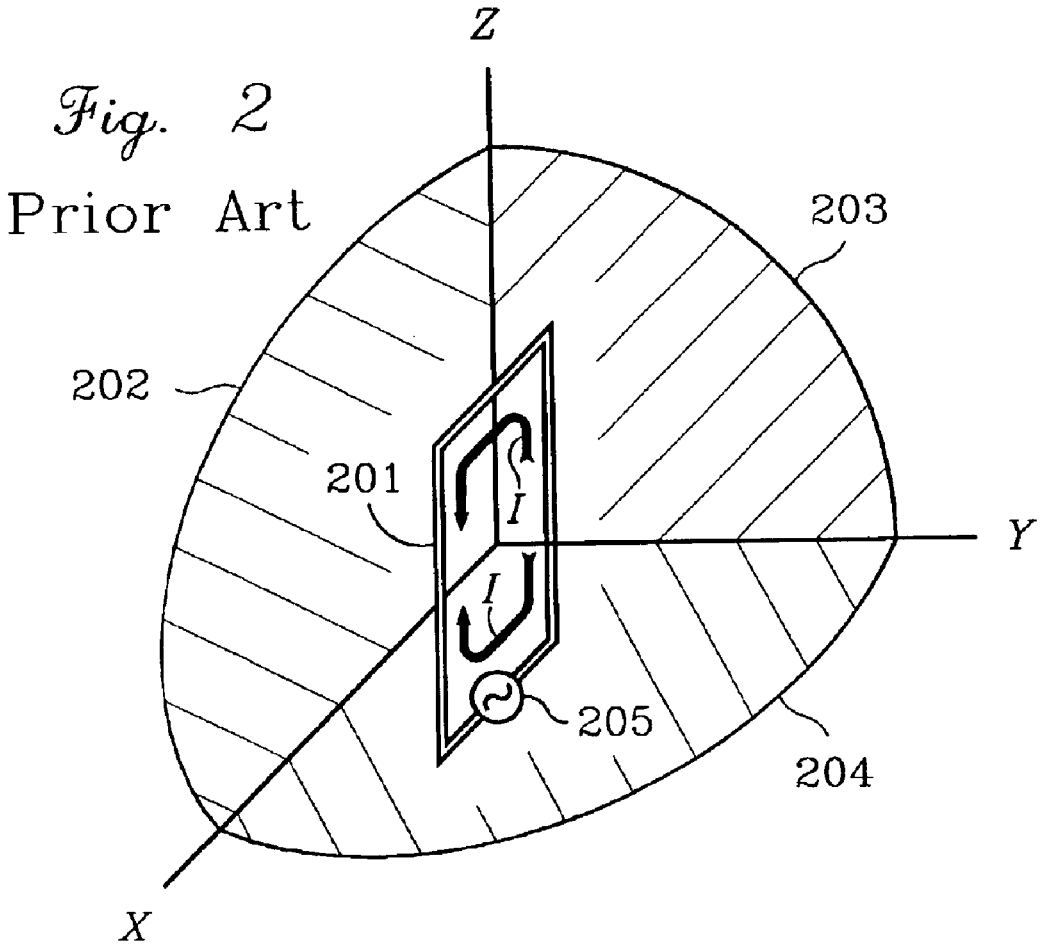
Fig. 2 Prior Art
FIG. 2 illustrates the conventional principal planes passing through a rectangular loop antenna.

One advantage of all of these loop antenna elements, relative to half-wave dipoles, is that they are less susceptible to receiving noise caused by precipitation. Another advantage is that they have directivity in the plane perpendicular to the major current-carrying conductors. FIG. 2, having parts 201 to 205, illustrates this plane, 203. Hereinafter in this description and the attached claims, this plane will be called the principal H plane, as is conventional practice. Hereinafter in this description and the attached claims, the plane, 204, that is perpendicular to the principal H plane and the plane, 202, of the loop, 201, will be called the principal E plane, as is conventional practice.

Figure 1A:
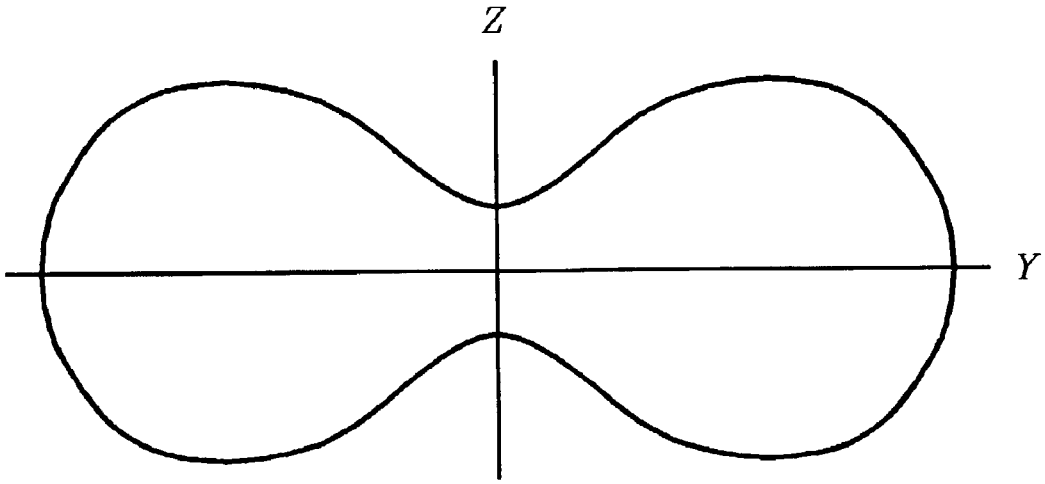
Prior Art Fig. 1A
FIGS. 1A, 1B and 1C illustrate some possible, simplified radiation patterns of antennas.

The amount of directivity that can be achieved with single loops is modest and similar to that illustrated by the radiation pattern of FIG. 1A. With more loops, the radiation pattern can be similar to that illustrated by FIG. 1B or 1C. Not only are such radiation patterns beneficial for the gain in the desired directions, but they also are beneficial for reducing the performance in undesired directions. In addition, if the principal H plane were vertical (horizontal polarization), these antenna elements would tend to perform well at low elevation angles. This is important at very-high and ultra-high frequencies because received signals usually arrive at low elevation angles. This also is important at high frequencies because long-distant signals usually arrive at low elevation angles and they usually are the weaker signals.

In addition to the lines representing the conductors, there are wide arrows in FIG. 2 and FIGS. 4 to 14 to indicate some aspects of the currents. That is, these arrows indicate that current maxima are at the centers of the arrows, current minima are where the arrowheads and arrow tails face each other, and the current maxima, at any particular time, are very approximately out of phase with each other at adjacent arrows of particular current paths. However, not much else should be assumed about these currents. Particularly, it should not be assumed that different currents necessarily have equal magnitudes and phases just because they are all called I, that the current phase is constant within any particular arrow, or that there are sudden changes in phase where the arrowheads and arrow tails face each other.

Prior Art—The Lemniscate Curve

Figure 3:
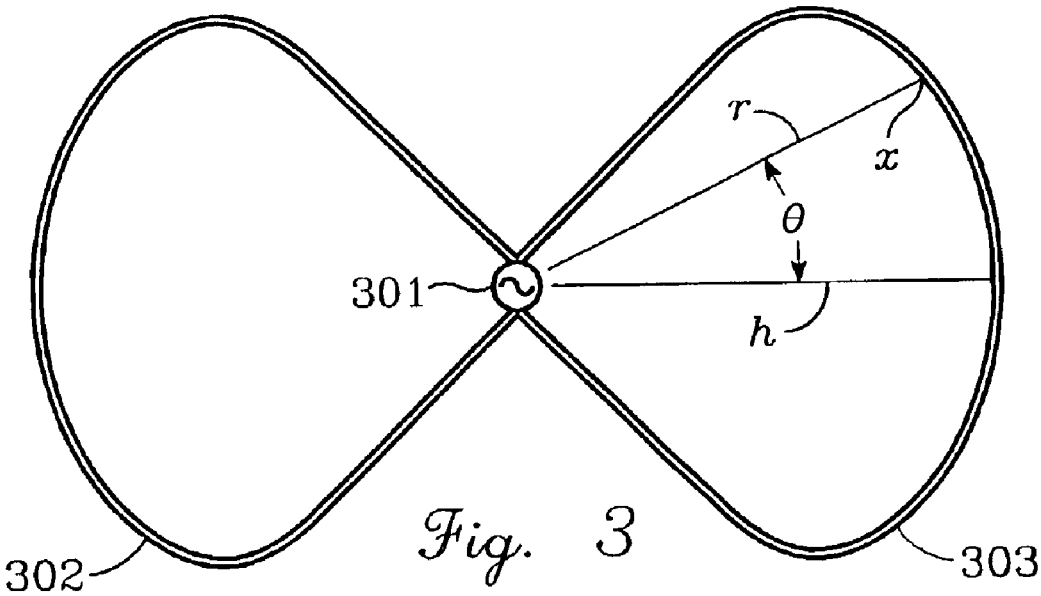
Fig. 3 Prior Art
FIG. 3 illustrates the basic nature of the lemniscate curve.

The shape of a pair of triangular loops, as in FIG. 6A, which hereinafter will be called a double-delta antenna element, perhaps is obvious, but an explanation probably is appropriate for the lemniscate shape of U.S. Pat. No. 6,255,998. FIG. 3, with the generator symbol, 301, feeding the two conducting loops, 302 and 303, illustrates the basic lemniscate shape. Note that the generator is connected from one side of both loops to the other side of both loops. That is, it is connected in series with both of the loops. It is definitely not connected between one loop and the other loop, which would change the current patterns and make the element a type of dipole.

Although an advantage over triangular loops can be achieved by simply bowing outward the outer sides of the triangles, it is convenient for mathematical analysis to express the shape by a mathematical formula. The curve known by mathematicians as a lemniscate serves this purpose very well because, by changing the parameters, it can produce a wide variety of curves that are not only similar to the curve of FIG. 3 but that describe antenna elements that are desirable.

The reason for considering the lemniscate for a double-loop antenna element is its similarity, in an important respect, to the triangle. The advantage of both triangles and lemniscates seems to be based on a superior distribution of the major radiating parts of the loops. That is, the radiation is reduced at the central corners of such pairs of loops, because there are opposing currents in conductors that are somewhat side-by-side, leaving the parts of the loops opposite those corners to produce most of the radiation. This separates the major radiating parts of such loops and leads to more gain than can be obtained with other loop shapes. To produce a term that would be appropriate when it is necessary to refer to triangles, lemniscates, and similar shapes collectively, hereinafter in this description and the attached claims, those major current-carrying conductors opposite the corners will be called the major radiating conductors.

Note that it is not necessary that the central corners be actual sharp corners. What is necessary is that conductors near those corners are placed so that the radiation is somewhat suppressed. That is, the corners could be rounded. Therefore, hereinafter in this discussion and the attached claims, such "corners" will be called approximate corners. As long as the loops are significantly wider far from the central points than they are near to the central points, there should be an advantage over the older squares, diamonds, circles, etc.

Before the lemniscate curve is described in detail, it is convenient to define some more terms. The generator symbol, 301, perhaps obviously represents the connection to the associated electronic equipment. Hereinafter in this description and the attached claims, the associated electronic equipment will be the type of equipment usually connected to antennas. That equipment would include not only transmitters and receivers for communication, but also such devices as radar equipment and equipment for security purposes. Hereinafter in this description and the attached claims, the central conductors, parts, points, or sides of these pairs of loops will be the conductors, parts, points, or sides located at the center of the pairs where the approximate corners meet. Hereinafter in this description and the attached claims, the outer conductors, parts, points, or sides of these pairs of loops will be the conductors, parts, points, or sides located at the points farthest from the central approximate corners. Hereinafter in this description and the attached claims, the distances between the central points and the outer points of the loops will be called the heights of the loops. Hereinafter in this description and the attached claims, the maximum dimension perpendicular to the height of the loops will be called the width of the loops.

As FIG. 3 illustrates, the shape of the lemniscate curve is such that the radius (r) from the central point to any point (x) on the curve is the height (h), multiplied by the cosine, raised to a power (p), of the angle (θ) between the center line of the loops and a line from the central point to that point (x) on the curve, multiplied by a constant (m). Because the cosine has negative values and negative radii do not make much sense, the absolute value is desired. Hereinafter in this description and the attached claims, p will be called the power constant of the curve and m will be called the multiplying constant of the curve.

$$r=h|\cos(m\theta)|^p$$

where $-\pi/2m<\theta<\pi/2m$ and $(\pi-\pi/2m)<\theta<(\pi+\pi/2m)$

It is necessary to limit the angle to values around zero and π radians because it is possible, with some values of multiplying constant, to obtain more than two loops from the above expression. Because the purpose of the expression is just to represent the invention approximately, it is legitimate to limit the expression to whatever adequately represents the invention. Also note that because the cosine has its maximum values for mθ equaling zero and π radians, these are the values that will produce the outer points of the curve.

The multiplying constant controls the angle at which the loops approach the center and, thereby, influences the width of the loops. For example, if the multiplying constant were 2, the cosine would be zero when the angle equaled π/4 radians because mθ would be π/2 radians. Of course, the width influences the resonant frequency because it influences the size of the loops. More obviously, the height also influences the resonant frequency. A less obvious fact is that both the multiplying constant and the height influence the shape of the radiation pattern. Therefore, the task of producing the desired radiation pattern with resonance involves the adjustment of both the multiplying constant and the height. For that task, an antenna analysis computer program is most desirable.

The power constant also influences the overall shape of the loops. For example, a mathematician would realize that if the power constant equaled one and the multiplying constant equaled one, the loops would be circles. Because such loops would not approach the central point with the two sides of the loop approximately side-by-side, thereby not reducing the radiation from the central point, such a combination of power constant and multiplying constant would not be an improvement on the prior art. For another example, if the power constant were much less than one, the loops would have long, almost straight portions near the center. In the extreme case, for a power constant equaling zero, the loops would be sectors of a circle.

Although lemniscate curves can produce more gain for a particular bandwidth than triangles, or more bandwidth for a particular gain, perhaps that is not their main advantage. With triangles, there is only one set of dimensions that yield the FIG. 1B type of radiation curve that reduces the minor lobes of radiation very well. That is because there is only one shape, a triangle, that is available. The lemniscate curves, on the other hand, are a set of curves. Therefore, for each type of curve there are dimensions that can produce the FIG. 1B type of radiation curve. That is, it is possible to choose the combination of gain and bandwidth while still choosing the kind of radiation curve. With triangles, once the choice of gain and bandwidth is made, the type of radiation curve is determined.

Figure 1B:
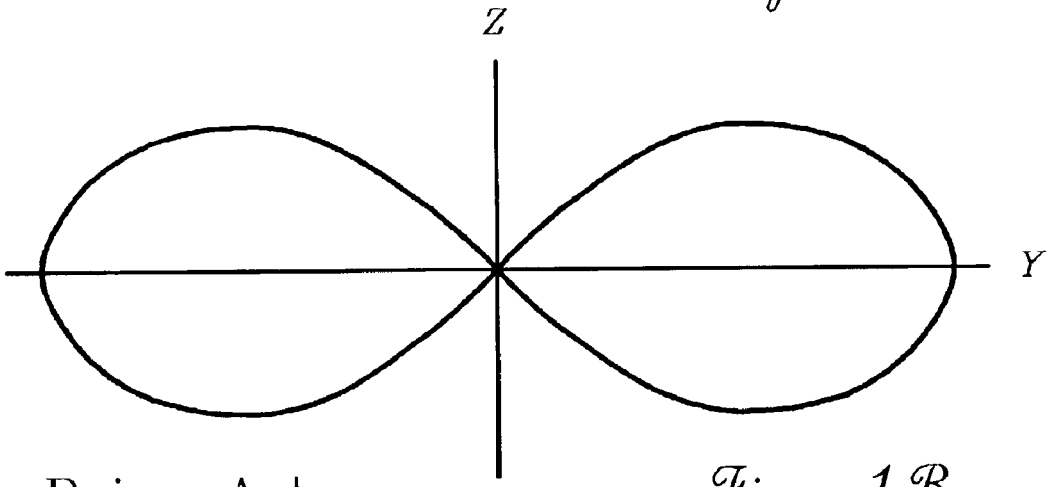
Prior Art Fig. 1B
Figure 1C:
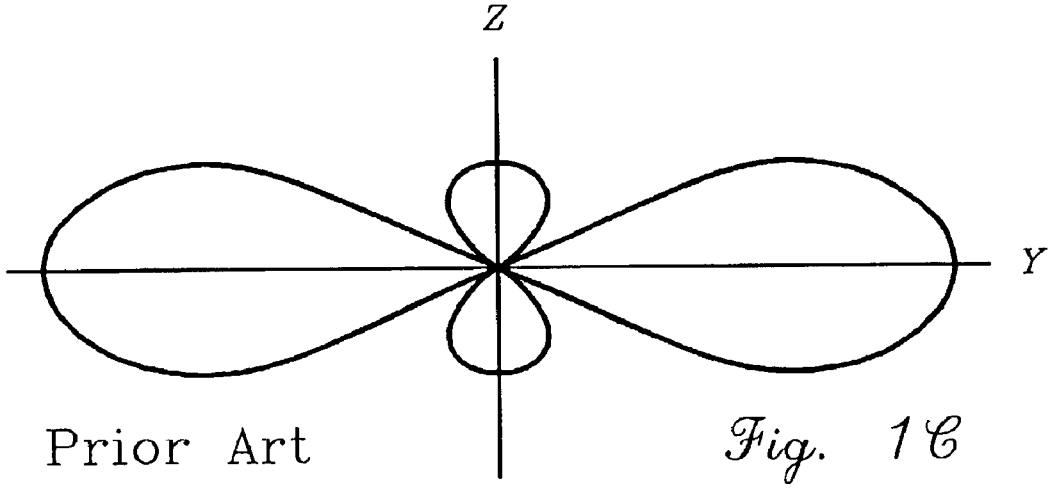
Prior Art Fig. 1C

For example, with dimensions chosen to produce the FIG. 1B type of curve, values of the power constant that are close to zero produce curves that are relatively low in gain and high in bandwidth. Values of the power constant that are larger but still less than unity produce more gain with less bandwidth. Values of the power constant above about 0.4 or 0.5, produce modest increases in gain with substantial decreases in bandwidth. This is because the values of multiplying constants needed to produce the FIG. 1B type of curve, with such power constants, are so close to one that the curves approach the central point almost from the side. This defeats the purpose of using these curves, which is to reduce the radiation from the center of the element.

In conclusion, the lemniscate gives the designer more flexibility to produce the desired antenna element than does the triangle. Indeed, the flexibility extends to the possibility of using a series of straight conductors, instead of smooth curves, to simulate the lemniscate shape. As long as the major radiating conductors are bowed outward, such antenna element shapes seem to have an advantage over the strictly triangular shape.

Prior Art—Four Loops

Figure 4:
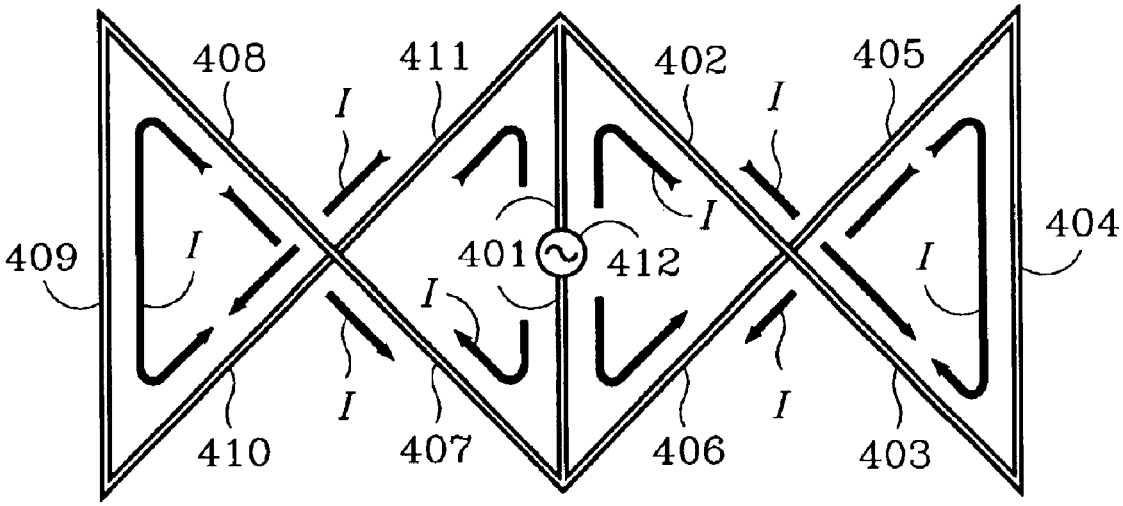
Fig. 4 Prior Art
FIG. 4 illustrates a quadruple-delta antenna element.

The expansion of the invention to the four-loop quadruple-delta antenna element of U.S. Pat. No. 5,966,100 is illustrated in FIG. 4 with parts 401 to 412. Parts 409, 401 and 404 are parallel to each other, carry current maxima and, apparently, the currents are flowing in the same direction at any particular time. For that reason, they are the major radiating conductors. Hereinafter in this description and the attached claims, such conductors will be called the parallel conductors. The remaining conductors have currents that either tend to cancel each other or do not entirely aid each other because the conductors are not parallel to each other. Hereinafter in this description and the attached claims, such conductors will be called the diagonal conductors.

Figure 11:
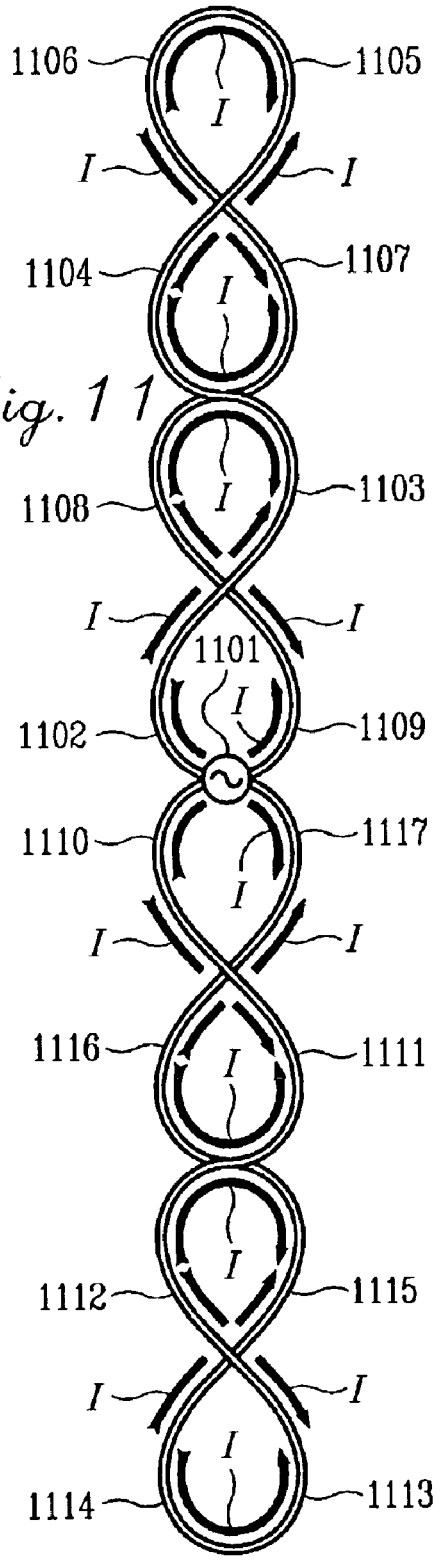
FIG. 11 illustrates a quadruple-lemniscate antenna element.
Figure 16:
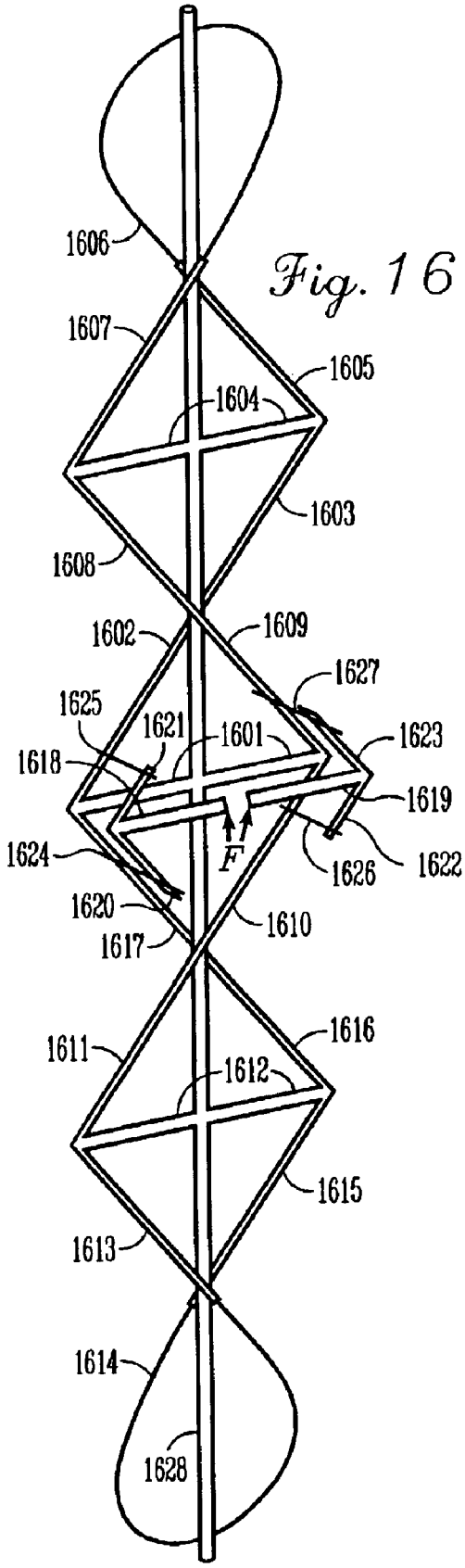
FIG. 16 illustrates a perspective view of a strengthened octuple-delta antenna element with single crossing conductors to show the options of lemniscate curves, conductors of different sizes, and an unconventional matching system.
Figure 22:
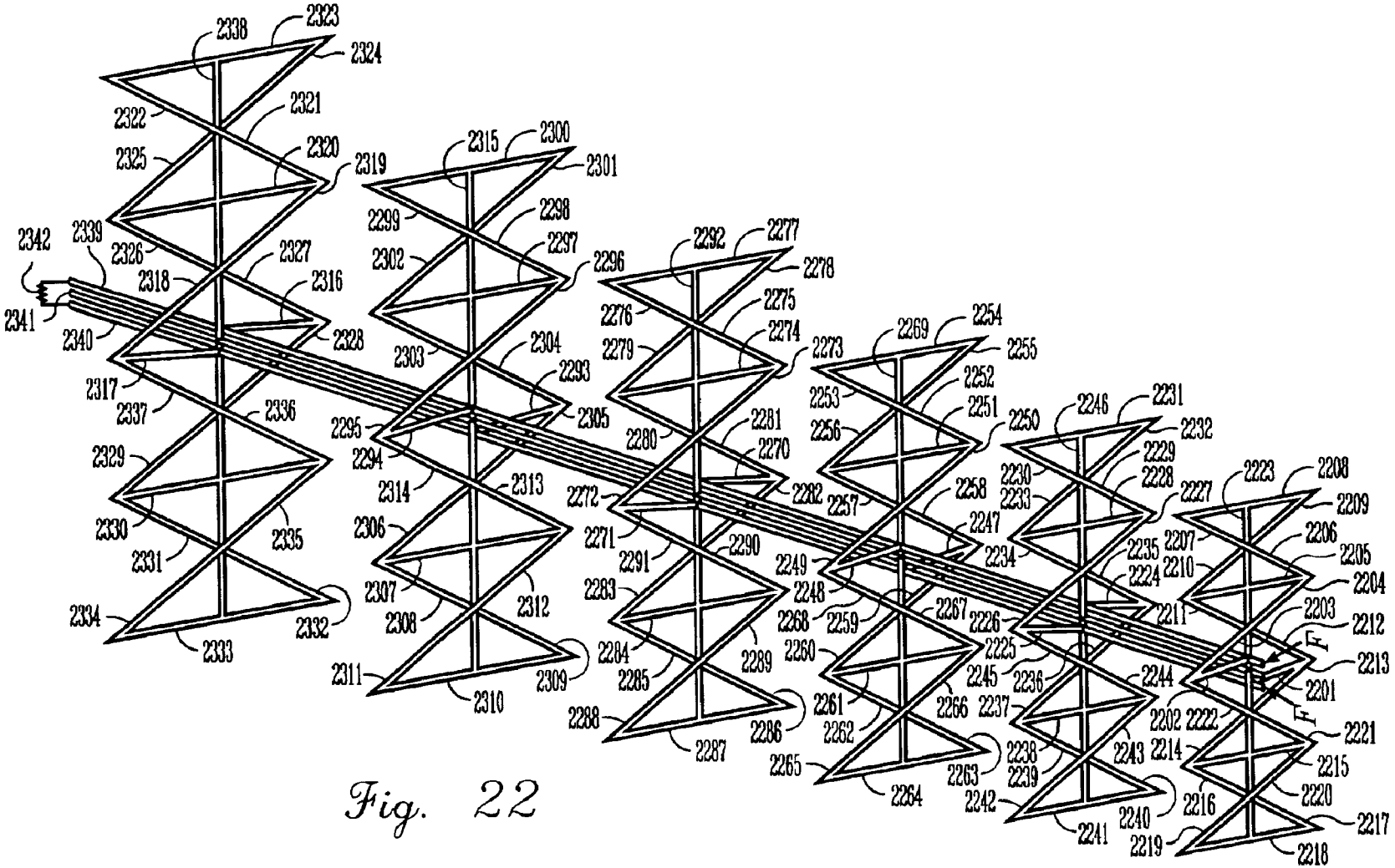
FIG. 22 illustrates a perspective view of a log-periodic array of strengthened octuple-delta antenna elements with single crossing conductors.

Note that all of the sides of the triangles have been given numbers, so that they can be designated individually. That is, parts 407 and 408 may be one piece of conductor, but they have been given two numbers because they are parts of two different triangles. Also, part 401 has one number because it is one side of the triangles, even though it is broken by the generator symbol, 412. Also note that the crossing diagonal conductors do not touch each other. That is, one current path is from part 401, through parts 402 to 406, and back to part 401. This numbering plan has been applied to the other drawings of antennas, except for FIGS. 3, 11, 16, and 22. In FIGS. 3 and 11, there are curves rather than sides and FIG. 16 has both. In FIGS. 3 and 16, it is convenient to give numbers to whole curves but, in FIG. 11, it is convenient to number each side of the curves to expose the current paths more clearly. In FIG. 22, the broken central sides were given two numbers because there was a need to refer to the halves of those sides individually.

The antenna element of FIG. 4 appears to be two double-delta antenna elements joined by a common side, 401. Note that it has been chosen that the outside parts, 404 and 409, would be parallel to the central part, 401. That is, the alternative possibility of having approximate corners at the center and at the ends was not chosen. In FIG. 4, there are three major radiating conductors, 409, 401 and 404, separated by the heights of two loops. If the loops had been put together with approximate corners at the ends and at the center, there would be only two major radiating conductors with approximate corners reducing radiation at the ends and at the center.

Figure 5:
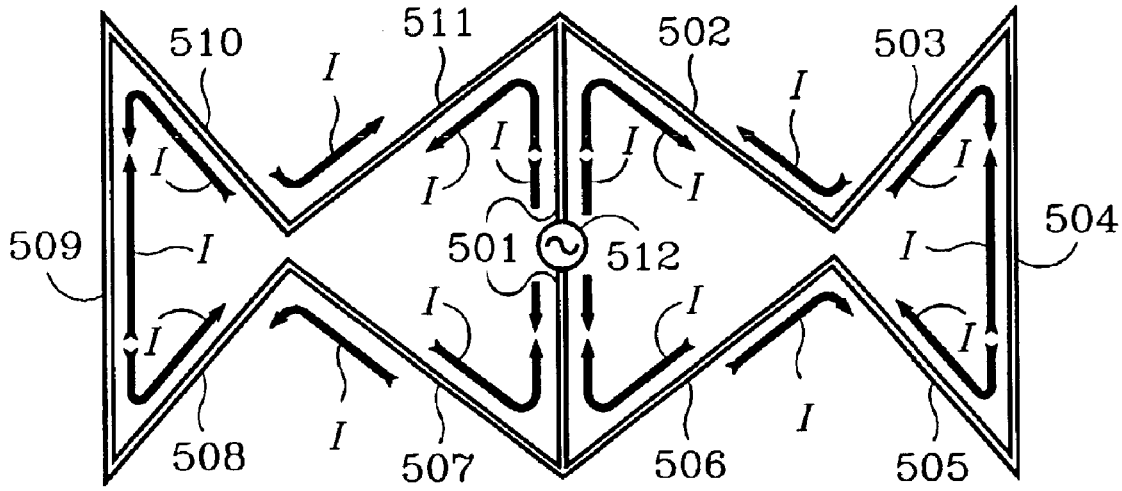
Fig. 5 Prior Art
FIG. 5 illustrates an expanded quadruple-delta antenna element.

FIG. 5, with parts 501 to 512, shows another embodiment of the four-loop antenna element called the expanded quadruple-delta antenna element that was disclosed in U.S. Pat. No. 5,805,114. Instead of the approximately one-wavelength loops of the quadruple-delta antenna element, this embodiment has loops with perimeters that are much larger. Typically, the inner loops have perimeters of approximately two wavelengths and the outer loops have perimeters of approximately one and three-quarters wavelengths. This produces a wider element as well as a higher element and produces a significantly larger gain.

Prior Art—Strengthening Conductors

A convenient means of strengthening such antenna elements so that an all-metal element is possible was disclosed in U.S. Pat. No. 5,995,060. FIGS. 6A, 6B and 6C illustrate the tactic, with part 608 being added to parts 601A, 601B, and 602 to 607. If the associated electronic equipment were attached to the antenna element in a balanced manner, as it should be to reduce radiation in undesired directions, the central point would be at ground potential. Away from that point on one particular loop, there would be instantaneous voltages of equal magnitude but opposite polarities at places that are equidistant from the central point. The voltages would be of equal magnitude, because they are equidistant from the ground and because the element is symmetrical. The voltages would be of opposite polarities, because no net current would flow between these points if they had voltages of the same polarity.

The center of the outer part of either loop is equidistant from the central point by the two paths around the loops. Therefore, the voltage at that point must be equal in magnitude and of opposite polarity to itself. Obviously, the only voltage that satisfies those conditions is zero volts. That is, whatever the voltages may be at the other parts of the loop, they must reach zero volts at the centers of the outer parts of the loops. In other words, that point is at ground potential.

If the central point of the whole antenna element and the center of the outer conductors were both at ground potential, it is apparent that no current would flow in the additional part 608 because of that connection. Hereinafter in this description and the attached claims, such an added conductor will be called a strengthening conductor. In addition, an examination of the current patterns surrounding this strengthening conductor shows that this conductor is equidistant from currents flowing in opposite directions in the other conductors. That is, there would be no net fields inducing voltages into this strengthening conductor. It would be a conductor that did not conduct because no net voltages were applied to it by conduction or induction. As far as the electrical performance of the antenna element is concerned, this strengthening conductor might as well not be there. However, a strengthening conductor can make an antenna element much stronger.

Of course, for the above explanation to be absolutely true, the element must be perfectly balanced. However, if the balance were good enough, the current in the strengthening conductor would be small enough to be insignificant. Perhaps it is apparent that the above explanation is equally valid for strengthening conductors applied to larger, symmetrical, antenna elements that are connected in a balance manner, such as the quadruple-delta and expanded quadruple-delta antenna elements. In addition, U.S. Pat. No. 6,333,717 disclosed that strengthening conductors can be placed anywhere in the principal H plane between points at ground potential without disturbing the electrical performance of the antenna. Such diagonal supports not only can support the antenna in the usual sense, but they also can reduce the motion between elements caused by the wind. Such motion would change the operation of the antenna, and may be particularly important with the high-gain antennas of this disclosure.

THE INVENTION

The Invention—Introduction

Since this prior art performs well, it is reasonable to investigate combinations of more loops of this type. Because it usually is desirable to have the maximum gain in the direction perpendicular to the plane of the loops, that preference would logically guide the investigation toward antenna elements that are symmetrical around the central point of the antenna elements. And since single triangular loops are not symmetrical, such investigations would logically be guided toward even numbers of loops, rather than odd numbers of loops. That is, three or more pairs of loops should be investigated. However, it is possible to have a symmetrical loop, such as a rectangle, in the center of an array of triangular loops, and still have the maximum radiation perpendicular to the plane of the loops.

Hereinafter in this description and the attached claims, the loops surrounding the places where the diagonal conductors meet will be called pairs of loops. Hereinafter in this description and the attached claims, two loops placed between the places where the diagonal conductors meet will be called adjacent loops.

Since the radiation near the approximate corners of the pairs of loops is reduced and the outer curves carry the major radiating currents, it is logical that outer curves of the pairs would form the outer conductors of the antenna elements. These thoughts would lead to two sets of embodiments: odd numbers of pairs of loops (3, 5, 7, etc.), with approximate corners at the centers of the elements, and even numbers of pairs of loops (4, 6, 8, etc.), with outer curves at the centers of the elements.

The Invention—Six Loops

Figure 7:
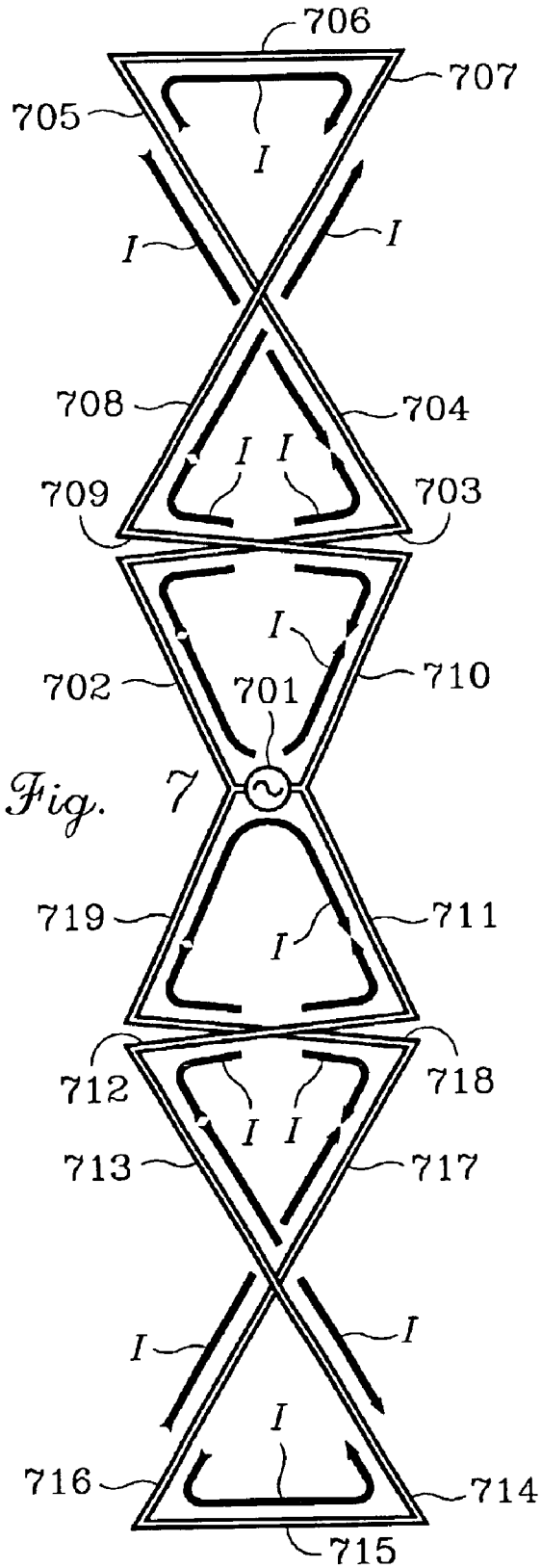
FIG. 7 illustrates a sextuple-delta antenna element with dual crossing conductors.

To begin the investigation, FIG. 7, with parts 701 to 719, illustrates a three-pair-of-loops embodiment of the invention. This antenna element has six approximately parallel conductors, 706, 703, 709, 712, 718, and 715, which are connected by the remaining diagonal conductors. Note that where the diagonal conductors cross and where the inner parallel conductors cross, there are no connections. That is, there is a single current path from the generator symbol, 701, through conductors 702 to 710, to return to 701. The other current path is from 701, through 711 to 719, and back to 701. Because the loops have perimeters of approximately one wavelength, there are current maxima at the centers of the parallel conductors and near the places where the diagonal conductors cross. However, because it usually is desirable to have parallel conductors of unequal lengths, the current maxima on the diagonal conductors usually would not be exactly where the diagonal conductors cross and the crossing points would not be exactly half-way between the adjacent parallel conductors.

Because the diagonal and inner parallel conductors do not touch each other where they cross, it is apparent that the antenna element is not quite coplanar. That raises the question of which conductors should be in front of the other conductors. If the separation of the conductors were very small compared to a wavelength, that question probably would not be significant. Nevertheless, it may be prudent for an array of such antenna elements to use the same system for all the elements, so that the distances between the corresponding conductors in adjacent elements would be approximately equal.

The parallel conductors are the major radiating conductors because they carry current maxima flowing approximately in the same direction at any one time. Therefore, the fields that they produce should assist each other in the direction perpendicular to the plane of the loops. Because of the symmetry, the current in conductor 706 should equal the current in conductor 715, but there is no reason to suspect that they are equal to the currents in the other four parallel conductors. The diagonal conductors have current maxima as well, but their effect on the total field would be less. Their radiating effect caused by current components flowing up and down in FIG. 7 would be very small because for each current there is a corresponding current flowing in the opposite direction. Their radiating effect caused by current components flowing side to side in FIG. 7 would be small because the conductors are not positioned parallel to each other. Therefore, it is a rough but reasonable approximation to consider that the significant parts of this antenna element are the six parallel conductors, and the diagonal conductors just are supporting the parallel conductors.

With its one-wavelength loops and the apparent desirability to have the currents in the approximately parallel conductors flowing in the same direction at the same time, the antenna element shown, with the pairs of parallel crossing conductors, is fairly logical. However, that crude logic is based on the idea that the currents are of equal magnitudes and equal phases throughout the antenna element. Such logic ignores the radiation from each conductor to each other conductor, which changes the magnitude and phases of the currents. That logic also seems to be based on the idea that the current pattern would be similar to the pattern on a lossless transmission line with a short or open circuit on the end. That pattern does have current nulls, uniform phases between the nulls, etc. That logic ignores the fact that antennas should lose power to their environment, in the transmitting case and, therefore, are not at all lossless. The reality is that it is difficult to predict by logic what the amplitudes and phases of the currents would be and what the sizes of the loops should be for good performance.

The dimensions of such antenna elements are influenced by several factors. In order to have the maximum radiation perpendicular to the plane of the loops, it usually would be desirable to have conductors of equal dimensions if they were equidistant from the center of the element. However, within the requirement of loop perimeters of approximately one wavelength, there is no reason to expect that the conductors that are not equidistant from the center would have such a rigid relationship. Likewise, there is no reason to expect that the dimensions of a single element would have the same dimensions as the various elements in an array. The operating frequency, gain, bandwidth, and the cross-sectional dimensions necessary for mechanical strength also will influence the dimensions of the elements. For these reasons, a computer program is most desirable for designing such elements.

As it is with large antennas, it is common practice that the conductors at the point of support would be stronger and, therefore, heavier than the conductors at the ends of the antenna. However, it is convenient to quote dimensions that allow the reasonable comparison of various antenna elements. Therefore, in the inventor's patents, dimensions have been quoted for conductors having one-quarter-inch diameters in designs for the 144- to 148-megahertz amateur-radio band. For that service, a reasonable set of dimensions follows. The outer parallel conductors would be 0.24 free-space wavelengths long, and the inner parallel conductors would be 0.28 free-space wavelengths long. The perpendicular distance between the inner parallel conductors would be 0.75 free-space wavelengths, and the perpendicular distances between the inner and outer parallel conductors would be 0.85 free-space wavelengths. These dimensions produce an element that has a radiation pattern similar to that illustrated by FIG. 1B, except that there are tiny minor lobes of radiation where there is a null in FIG. 1B.

As it is with the prior-art smaller elements, one can expect that if the parallel conductors were made shorter and the perpendicular distances between the parallel conductors were increased, the element would have a higher gain and a narrower bandwidth. Likewise, longer parallel conductors spaced more closely would give less gain and more bandwidth. One also could design for other goals, such as the suppression of minor radiation lobes or the level of the impedance at the generator.

The Invention—Single Crossing Conductors

Figure 8:
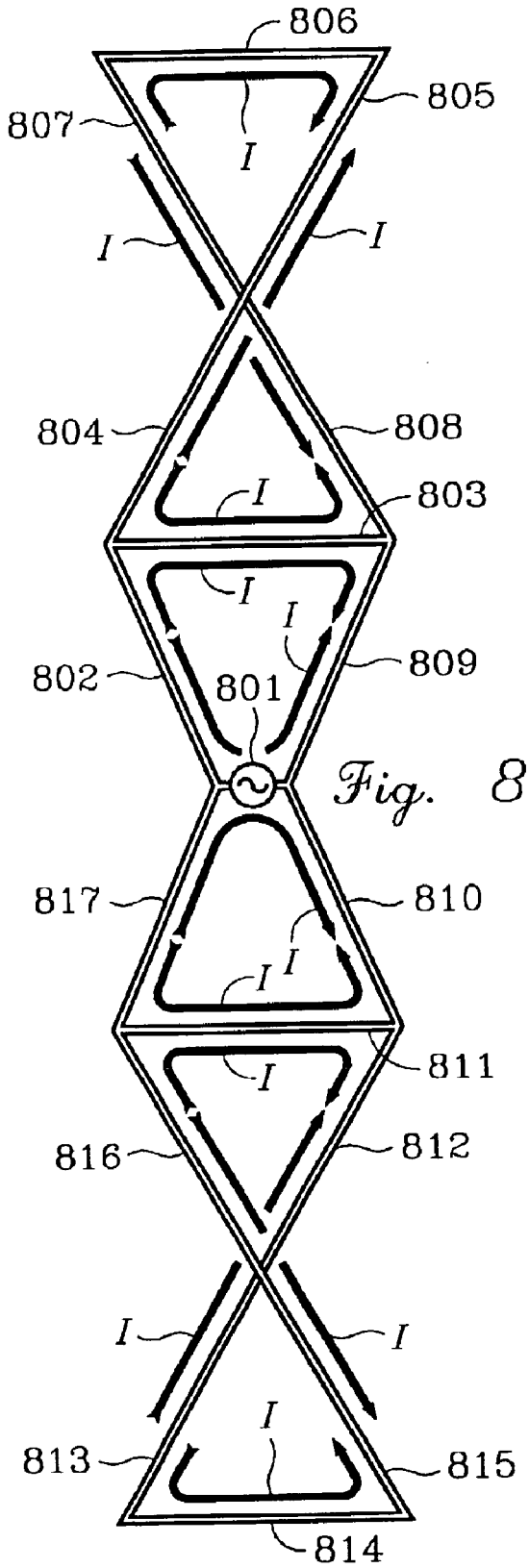
FIG. 8 illustrates a sextuple-delta antenna element with single crossing conductors.

The pairs of crossing parallel conductors, such as conductors 703 and 709, present a mechanical disadvantage. Not only must there be insulators between these conductors to prevent contact, but these insulators also will be supporting the outer loops. Even though the insulators would be short and, therefore, rather strong, it still is a disadvantage to have much of the element supported by insulators that must be weaker than conductors. FIG. 8, with parts 801 to 817 solves that problem by replacing the pairs of crossing parallel conductors with the single crossing conductors 803 and 811. Although it is not apparent that such a change would work and although the desirable dimensions are somewhat different, this embodiment works very well. Indeed, the desirability of having an all-metal element with fewer parts is so great, it is assumed that the embodiment of FIG. 8 would be preferred to the embodiment of FIG. 7 in nearly all cases. Hereinafter, this embodiment will be called a sextuple-delta antenna element with single crossing conductors. Hereinafter, the embodiment with pairs of crossing conductors will be called a sextuple-delta antenna element with dual crossing conductors.

For the same design goal of producing the FIG. 1B type of radiation pattern, one reasonable set of dimensions with one-quarter-inch conductors follows. The outer parallel conductors would be 0.25 free-space wavelengths long, and the inner parallel conductors would be 0.28 free-space wavelengths long. The perpendicular distance between the inner parallel conductors would be 0.74 free-space wavelengths, and the perpendicular distances between the inner and outer parallel conductors would be 0.79 free-space wavelengths. With the above quoted dimensions, the only slight disadvantage to the FIG. 8 embodiment seems to be a smaller impedance at the generator. A high radiation resistance usually is desirable to make the loss resistances less significant and, thereby, produce a more efficient antenna element.

The Invention—Expanded Embodiments

Figure 9:
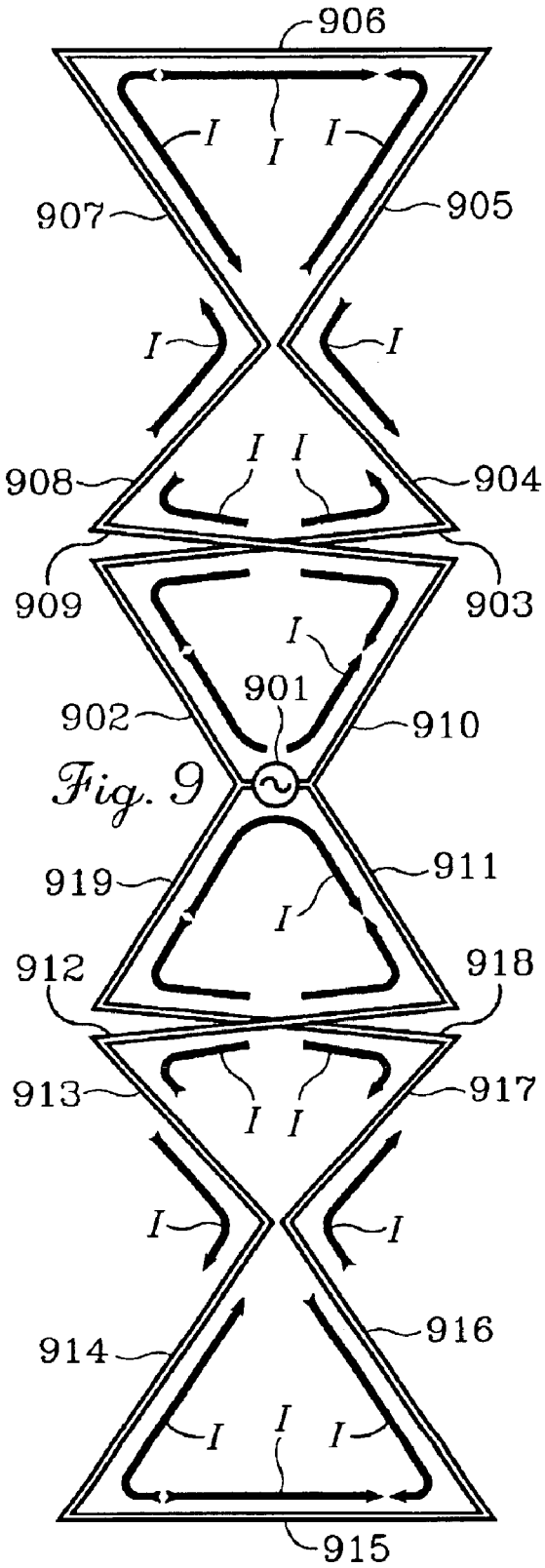
FIG. 9 illustrates an expanded sextuple-delta antenna element with dual crossing conductors.

As it is with the expanded quadruple-delta antenna element, it is worth investigating the use of larger loops. FIG. 9, with parts 901 to 919, illustrates such an embodiment. Hereinafter, such elements will be called expanded sextuple-delta antenna elements with dual crossing conductors. The differences from the sextuple-delta antenna elements with dual crossing conductors are that the elements are wider, the diagonal conductors do not cross, and there is considerable difference in the perimeters of the loops. As expected, loops that were equidistant from the center of the element would be approximately the same if the desired radiation were perpendicular to the plane of the element. However, except for the central pair of loops, there is no requirement that the two loops in any other pair should be the same as each other.

For the same goal of producing the FIG. 1B type of radiation pattern, a reasonable design with one-quarter-inch conductors follows. The outer parallel conductors would be 0.64 free-space wavelengths long, and the inner parallel conductors would be 0.54 free-space wavelengths long. There would be 0.74 free-space wavelengths between the inner parallel conductors, 0.31 free-space wavelengths between the inner parallel conductors and the places where the diagonal conductors almost meet, and 0.46 free-space wavelengths between the outer parallel conductors and the places where the diagonal conductors almost meet.

With the quadruple-delta antenna elements, the advantage of the expanded embodiment was more gain. That could be expected because the wider parallel parts would tend to narrow the pattern in the principal E plane and produce more gain. Therefore, it was unexpected that the above design produces slightly less gain than the design for the sextuple-delta antenna element with dual crossing conductors, but the bandwidth is much wider. Of course, that is a considerable advantage, but it is an unexpected advantage. Also, as usual, a design with more height and less width would produce more gain and less bandwidth.

Figure 10:
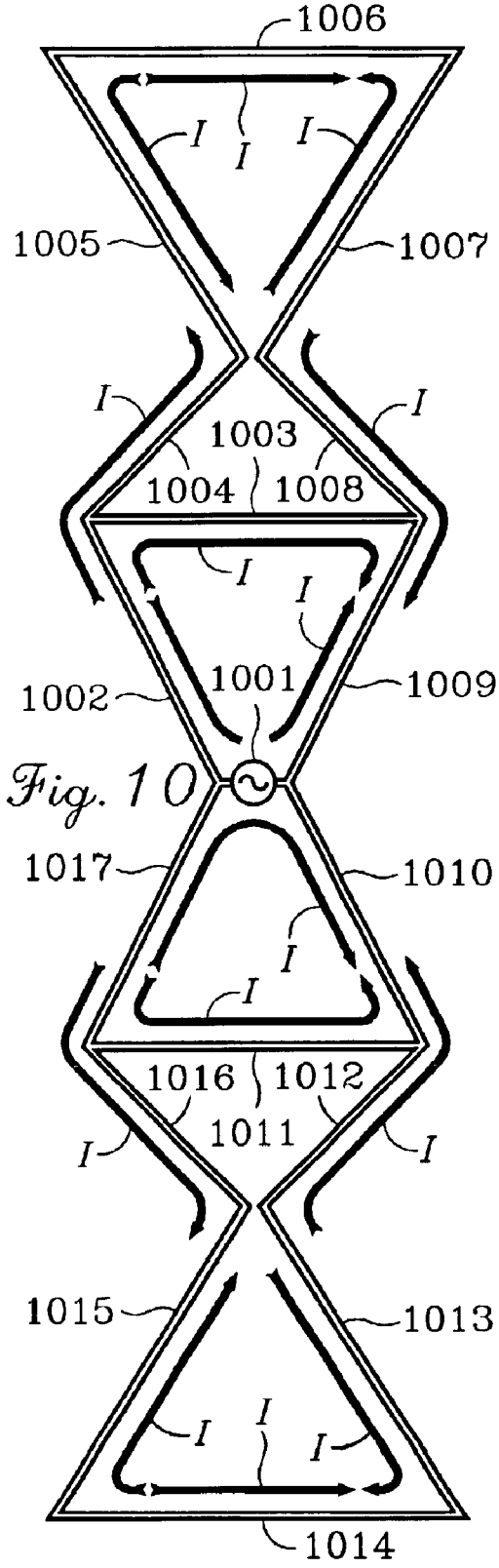
FIG. 10 illustrates an expanded sextuple-delta antenna element with single crossing conductors.

As is the case with the sextuple-delta antenna element, the expanded sextuple-delta can be made with single crossing conductors. FIG. 10, with parts 1001 to 1017, illustrates such an embodiment. Hereinafter this embodiment will be called an expanded sextuple-delta antenna element with single crossing conductors. For the FIG. 1B type of radiation pattern, with quarter-inch conductors, a reasonable design follows. The outer parallel conductors would be 0.67 free-space wavelengths long, and the inner parallel conductors would be 0.54 free-space wavelengths long. There would be 0.76 free-space wavelengths between the inner parallel conductors, 0.26 free-space wavelengths between the inner parallel conductors and the places where the diagonal conductors almost meet, and 0.51 free-space wavelengths between the outer parallel conductors and the places where the diagonal conductors almost meet.

This embodiment gives approximately the same gain and bandwidth as the embodiment using the pairs of crossing conductors, but the impedance at the generator is higher. As was noted above, the design for the sextuple-delta antenna element with single crossing conductors produced a lower impedance than the corresponding design with dual crossing conductors.

The Invention—Eight Loops

The second set of embodiments would use even numbers of pairs of loops. That is, there would be smooth curves in the centers of the elements instead of the approximate corners in the centers of odd-number-of-pairs embodiments. FIG. 11, with parts 1101 to 1117, shows such an antenna element having four pairs of loops or a total of eight loops. In this embodiment, the loops have the lemniscate shape, instead of the triangular shape. Since a lemniscate has two loops, hereinafter this type of element will be called a quadruple-lemniscate antenna element. The corresponding element using triangles will hereinafter be called an octuple-delta antenna element with dual crossing conductors. As was true with the sextuple-delta antenna element with dual crossing conductors, where the conductors cross, there is no connection. That is, one current path is from the generator symbol, 1101, through parts 1102 to 1109, and back to 1101. The other current path goes from the generator and returns via parts 1110 to 1117.

The use of the lemniscate curves has the same advantages as it has with smaller elements. That is, because there are more shapes of curves available, instead of just triangles, there is more flexibility available in designing the element. However, because there are more loops in the larger elements and, within limits, there is no need for them to be the same as each other, there is more flexibility in designing the larger elements with triangular loops as well.

A reasonable quadruple-lemniscate antenna element design for 144 to 148 megahertz would have a power factor of 0.2 and a multiplying factor of 3.1 for all eight loops. The heights of the four innermost loops would be 0.39 free-space wavelengths, and the heights of the four outermost loops would be 0.4 free-space wavelengths. A corresponding design for an octuple-delta antenna element with dual crossing conductors, follows. It would have outer parallel conductors 0.24 free-space wavelengths long, a central parallel conductor 0.22 free-space wavelengths long, and middle parallel conductors 0.23 free-space wavelengths long. The perpendicular distances between the central parallel conductor and the middle parallel conductors would be 0.77 free-space wavelengths, and the perpendicular distances between the middle parallel conductors and the outer parallel conductors would be 0.79 free-space wavelengths.

Both of these designs produce a significant increase in gain relative to that produced by the sextuple-delta antenna element with dual crossing conductors, but the bandwidth of the octuple-delta antenna element with dual crossing conductors is considerably worse. However, the octuple-delta antenna element with dual crossing conductors has a very high resistive component of the impedance, which might be an advantage. The quadruple-lemniscate antenna element has a slightly better bandwidth than the sextuple-delta antenna element with dual crossing conductors in addition to its significant advantage in gain. Another advantage of this quadruple-lemniscate antenna element is that the impedance variation over this frequency range is mainly in the reactance. Therefore it opens the opportunity of resonating the reactance with a stub, for example, to produce an excellent bandwidth as far as the impedance is concerned.

Both of these embodiments have large reactive components in their impedances, and that would cause some concern with some designers. However, such an attitude ignores the purpose of an antenna. It is prudent to design antennas to produce antenna factors like gain, bandwidth, etc. and then to match the antennas to the transmission line. Antenna systems should be resonant, but it is not necessary that the antennas be resonant by themselves. Large, complex antenna elements, with many conductors radiating to each other, may not have resistive impedances when they are performing well as antennas.

The Invention—Simulated Lemniscates

With the sextuple-delta antenna elements with single crossing conductors, it is apparent how the energy is transferred from the inner loops to the outer loops. In FIG. 8, it can be surmised that the current in the loop formed by parts 801, 802, 803, and 809 would create a voltage drop across part 803, and this voltage would produce the currents in the outer loops. It also should be suspected that there would be radiation from the inner loops to the outer loops but, one would suspect, that radiation would make a relatively small contribution to the currents in the outer loops. An apparent difficulty is that the smooth outer curves of lemniscates meet at points. Therefore, in FIG. 11, it would be suspected that if the point where parts 1103 and 1104 cross parts 1108 and 1107 were connected, that single-point connection would not feed energy to the outer loops. That is, it would be suspected that the outer loops would receive only radiated energy and that energy would be relatively small. In addition, there would be the mechanical disadvantage of having the outer loops supported by single-point connections.

Figure 12:
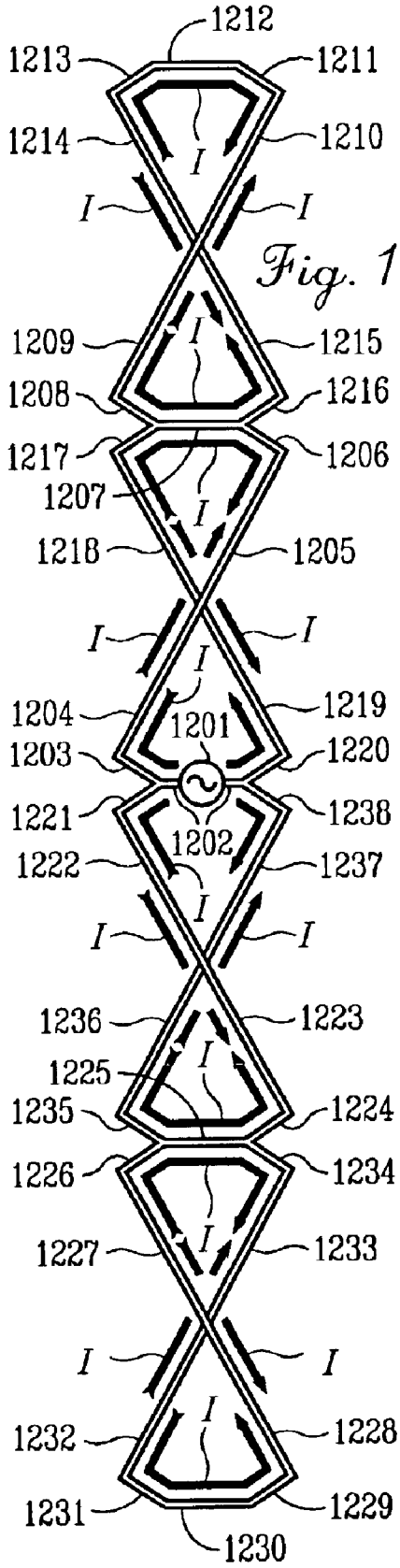
FIG. 12 illustrates a simulated quadruple-lemniscate antenna element with single crossing conductors.

That electrical analysis does not seem to be entirely realistic. Although the dimensions for good operation seem to be rather different and it may be difficult to get equally good performance, experiments show that it is practicable just to make those connections at the crossing points. However, a superior tactic is shown by FIG. 12, with parts 1201 to 1238. Since the lemniscate shape is just an analysis convenience, rather than a definite design requirement, it is reasonable to simulate the curve with a set of straight conductors, as in FIG. 12. In this example, it has been chosen to simulate the curve with straight conductors that provide outer parallel conductors instead of outer curves. With this embodiment, it is apparent that the energy is fed to the outer loops both by radiation and by voltage drops across the parallel conductors that are common to adjacent loops. Hereinafter such an antenna element will be called a simulated quadruple-lemniscate antenna element with single crossing conductors. Of course, the same tactic could be applied to six-loop embodiments.

A reasonable design for the simulated quadruple-lemniscate antenna element with single crossing conductors would have parallel conductors 0.11 free-space wavelengths long and the short diagonal conductors would extend 0.08 free-space wavelengths horizontally, in FIG. 12, and 0.12 free-space wavelengths vertically from the ends of the parallel conductors. The perpendicular distance between each pair of parallel conductors would be 0.79 free-space wavelengths. A corresponding design with triangular loops, which hereinafter will be called an octuple-delta antenna element with single crossing conductors, follows. The outer parallel conductors would be 0.25 free-space wavelengths long, the central parallel conductor would be 0.22 free-space wavelengths long, and the middle parallel conductors would be 0.23 free-space wavelengths long. The perpendicular distances between the central parallel conductor and the middle parallel conductors would be 0.77 free-space wavelengths, and the perpendicular distances between the middle parallel conductors and the outer parallel conductors would be 0.79 free-space wavelengths.

The gain of the above design for a simulated quadruple-lemniscate antenna element with single crossing conductors is only about the same as the sextuple-delta antenna element with dual crossing conductors, but this design suppresses the minor radiation lobes to a surprising degree. The octuple-delta antenna element with single crossing conductors has about the same gain and bandwidth as the octuple-delta antenna element with dual crossing conductors.

The Invention—Expanded Embodiments

Figure 13:
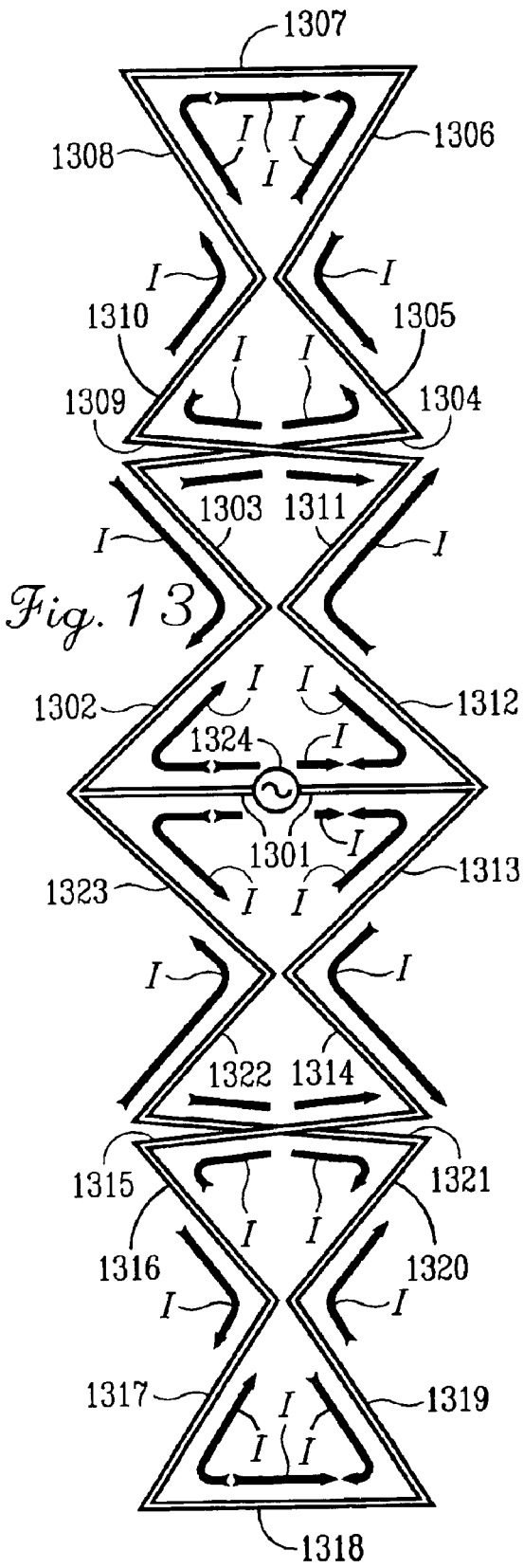
FIG. 13 illustrates an expanded octuple-delta antenna element with dual crossing conductors.
Figure 14:
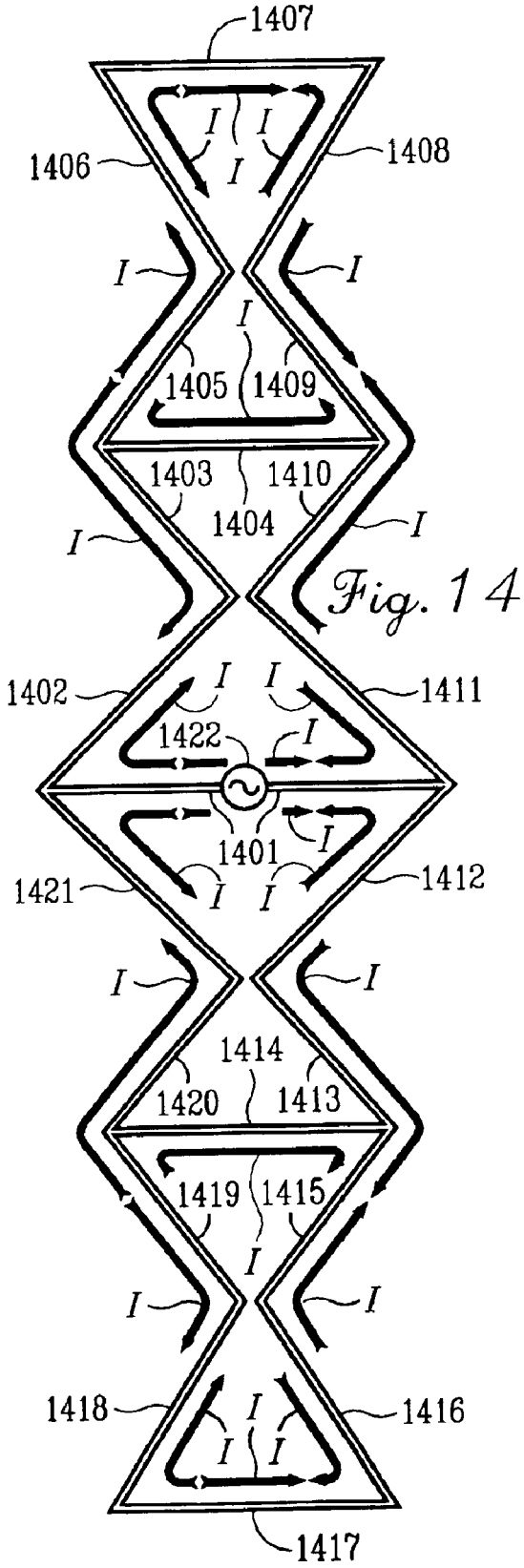
FIG. 14 illustrates an expanded octuple-delta antenna element with single crossing conductors.

As was true with the sextuple-delta antenna elements, it is useful to use expanded loops with the octuple-delta antenna elements. FIG. 13, with parts 1301 to 1324, and FIG. 14, with parts 1401 to 1422, illustrate the embodiments with pairs of crossing conductors and single crossing conductors. Hereinafter, they will be called, respectively, an expanded octuple-delta antenna element with dual crossing conductors and an expanded octuple-delta antenna element with single crossing conductors.

A reasonable design for an expanded octuple-delta antenna element with dual crossing conductors would have outer parallel conductors 0.62 free-space wavelengths long, a central parallel conductor 0.91 free-space wavelengths long, and middle parallel conductors 0.62 free-space wavelengths long. The perpendicular distances from the central parallel conductor to the middle parallel conductors would be 0.78 free-space wavelengths, and the perpendicular distances from the middle parallel conductors to the outer parallel conductors would be 0.86 free-space wavelengths. The perpendicular distances from the central parallel conductor to the nearest points where the diagonal conductors almost touch would be 0.42 free-space wavelengths, and the perpendicular distances from the outer parallel conductors to their nearest points where the diagonal conductors almost touch would be 0.64 free-space wavelengths.

A reasonable design for an expanded octuple-delta antenna element with single crossing conductors would have outer parallel conductors 0.61 free-space wavelengths long, a central parallel conductor 0.91 free-space wavelengths long, and middle parallel conductors 0.63 free-space wavelengths long. The perpendicular distances from the central parallel conductor to the middle parallel conductors would be 0.78 free-space wavelengths, and the perpendicular distances from the middle parallel conductors to the outer parallel conductors would be 0.86 free-space wavelengths. The perpendicular distances from the central parallel conductor to the nearest points where the diagonal conductors almost touch would be 0.44 free-space wavelengths, and the perpendicular distances from the outer parallel conductors to their nearest points where the diagonal conductors almost touch would be 0.47 free-space wavelengths.

These expanded designs produce considerably more gain than any of the designs discussed above, with bandwidths similar to the better designs and with good suppression of the minor lobes of radiation. Recall that the expanded sextuple-delta design produced better bandwidths and the simulated quadruple-lemniscate design produced better suppression of the minor lobes of radiation. Therefore, other choices of dimensions could produce different combinations of gain, bandwidth, etc.

The Invention—General Considerations

Another factor to consider in the choice of embodiments is that the supporting structure probably will be at the center of the element. Therefore, if the element had a major radiating conductor in the center and that conductor were approximately parallel with the supporting structure, it must be expected that the supporting structure would interfere with the operation of the antenna to some extent. In such cases, the six-loop elements may be preferred because the radiation from the central conductors is suppressed in these embodiments. An example of such a case would be a vertically polarized antenna, because the supporting mast or tower would be parallel to the major radiating conductors. Another example would be two horizontally polarized arrays positioned side-by-side, as in FIG. 21. Although the mast or tower would not be a problem to a horizontally polarized antenna, there probably would be a horizontal structure connecting the arrays to the mast or tower that could interfere.

Because useful embodiments have been found for strings of from two to twelve loops of this type, it must be concluded that longer strings could be useful. However, it must be remembered that doubling the power gain usually requires antennas that are twice as large, at least. Indeed, doubling the power gain with good radiation patterns usually requires antennas significantly more than twice as large. That is, the longer the string of loops is, the less advantage there is to adding a particular number of loops.

From this experience with triangular loops, it would not be expected that one just can string loops together that have perimeters of one wavelength. That seems to have been the erroneous assumption behind the strings of loops proposed before World War II, such as the Sterba curtain. Instead, the differences in the mutual impedances between the inner loops and the outer loops must be considered. However, only as a starting point, it may be useful to start the design procedure with one-wavelength loops for a regular series of loops and then to modify it to achieve a desirable design. With the expanded designs, there is no such obvious starting point because various combinations of loop sizes may be desirable. For example, note that the sample expanded sextuple-delta antenna elements had the largest loops at the outside and the expanded octuple-delta antenna elements had the largest loops at the center. One useful tactic may be to start with loop perimeters of one and one-half wavelengths, while being prepared to finish with significantly different loop perimeters.

The Invention—Ground-Mounted Embodiments

Figure 15:
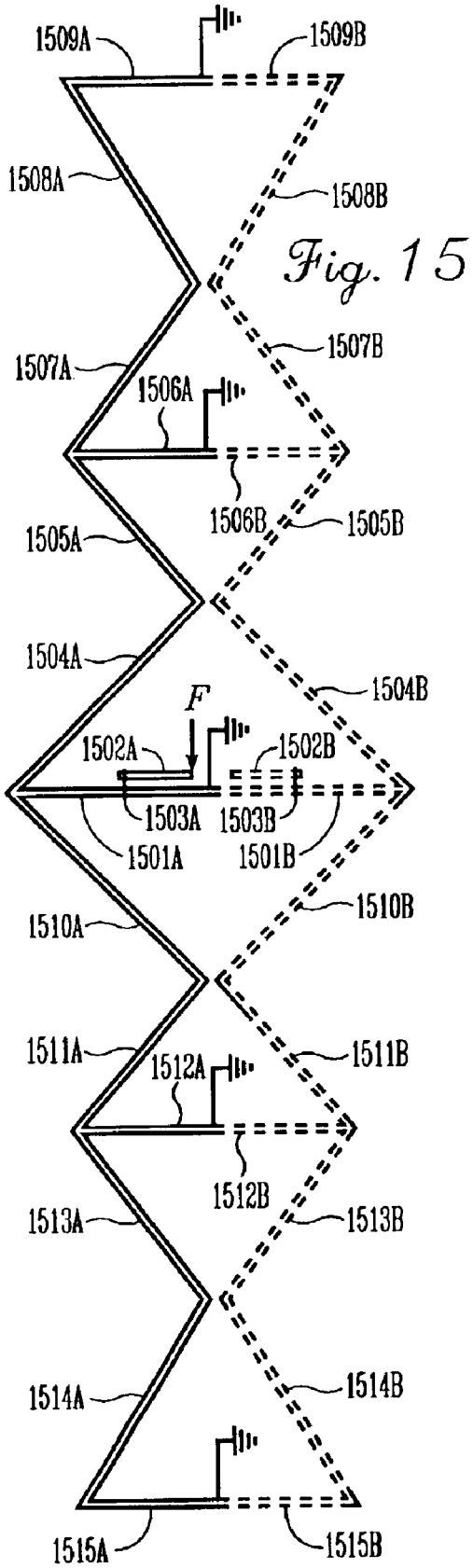
FIG. 15 illustrates a half expanded octuple-delta antenna element with single crossing conductors mounted on the ground.

Because the diagonal conductors do not cross and there are only single crossing conductors in the expanded designs with single crossing conductors, the antenna element in FIG. 15 is convenient for some purposes. Here is one-half of an expanded octuple-delta antenna element with single crossing conductors mounted on the ground. Hereinafter, this will be called a half expanded octuple-delta antenna element with single crossing conductors. The real antenna element has parts 1501A to 1515A and the image antenna element, which is the equivalent of the ground reflections, has parts 1501B to 1515B.

Such antenna elements are practicable because of the nature of currents in image conductors, which represent the effect of ground reflections. That is, the currents in image conductors that are perpendicular to the ground are in the same direction as the currents in the corresponding real conductors. Also, the currents in image conductors that are parallel to the ground are in the direction opposite to the direction of the currents in the corresponding real conductors. A comparison between FIGS. 14 and 15 will reveal that the currents in the image parts in FIG. 15 will indeed have the desired relationship to the currents in the real parts. Therefore, if there were good ground reflections, this antenna element would perform in a manner corresponding to the performance of the expanded quadruple-delta antenna element with single crossing conductors mounted entirely above the ground. A Yagi-Uda array of such antenna elements would produce a very-high-gain vertically-polarized antenna. Such a large antenna may be attractive for short-wave broadcasting stations, because they normally use very large antennas.

It is possible, but not very convenient, to produce such a ground mounted antenna element with the regular antenna elements with crossing diagonal conductors and pairs of crossing conductors, but special methods must be used to create the correct phase relationships between the currents. That is, something like phase reversing stubs at the ground points would be needed to reverse the currents.

As it is with most ground-mounted vertically polarized antennas, radial conductors would improve the apparent ground conductivity. This addition probably is more important with the antenna elements of this disclosure because they depend on the ground reflections to produce the desired currents. In addition, note that the ground also is the return path for the currents flowing back from the outer parallel conductors to the central parallel conductor. Therefore, it probably would be wise to have some of the radial conductors extending all the way between the bases of the parallel conductors to provide those return paths.

The Invention—Matching Systems

It is unlikely that the impedance presented to the feed point, represented by the generator symbols in previous diagrams, would be appropriate for connecting to the transmission line. Therefore, some kind of matching system usually is desired. In FIG. 15, this is provided by a conventional gamma match, with a gamma conductor, 1502A, and a shorting conductor, 1503A, connected to the feed point, F. Most probably, a capacitor would be used at point F to cancel the usual inductive reactance that the gamma match produces.

Because the distance from the ground to the first high impedance point, or current minimum, on the central parallel conductor usually is short in the expanded embodiments, the gamma conductor usually could be short to produce the desired impedance. FIG. 16, with parts 1601 to 1628, presents the opposite situation. Because the octuple-delta antenna elements and their lemniscate counterparts of FIGS. 11 and 12 have approximately half waves of current paths at their feed points, the matching conductors may be rather long. As shown in FIG. 16, in order to produce a desired balanced T match, the T conductors, 1618 and 1619, may not be long enough. It may be necessary to add the extensions, 1620 to 1623, parallel to the diagonal conductors, before the shorting conductors, 1624 to 1627, can terminate the matching system.

Figure 17:
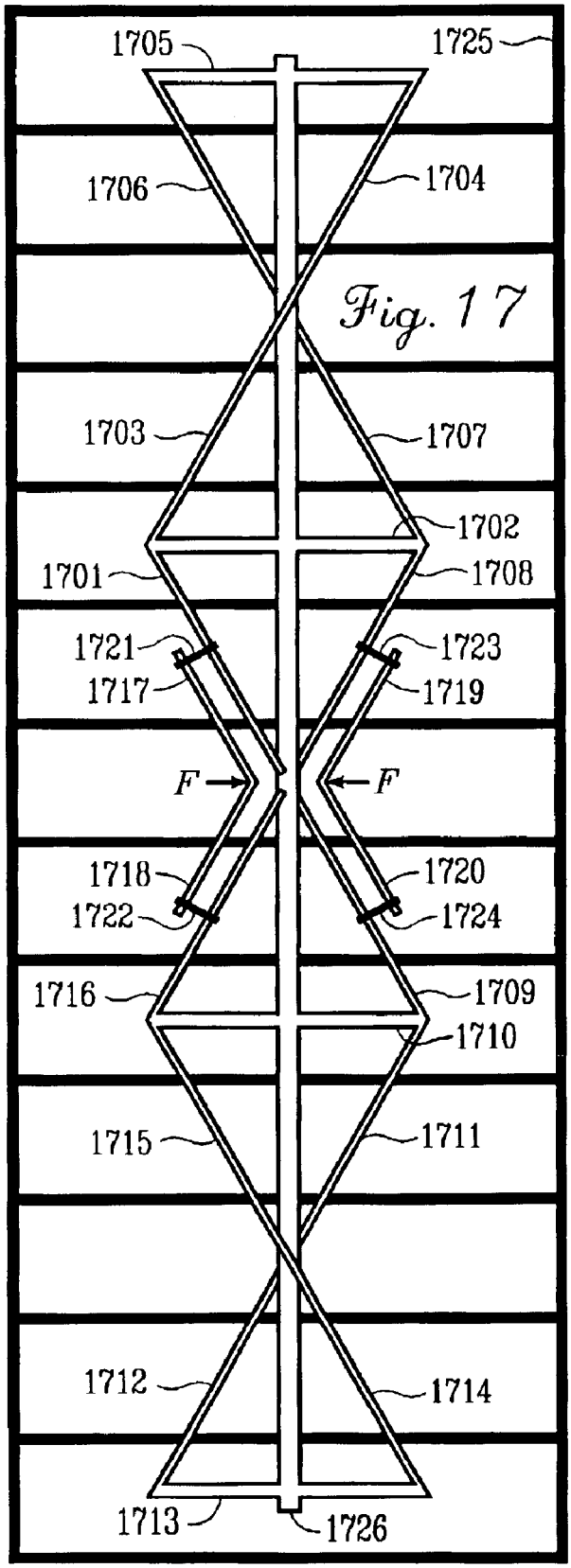
FIG. 17 illustrates a strengthened sextuple-delta antenna element with single crossing conductors in front of a reflecting screen.

A different situation is presented by the sextuple-delta antenna element with single crossing conductors of FIG. 17 with parts 1701 to 1726. As FIG. 8 shows, the current paths at the feed points of such antenna elements are long, but they usually do not extend to the crossing conductors. Therefore, it is likely that the T conductors, 1717 to 1720, would not need to extend beyond the diagonal conductors before being terminated by the shorting conductors, 1721 to 1724. Because this antenna element and the one in FIG. 16 are balanced, two tuning capacitors probably would be needed at the feed points, F. In addition, if the transmission line were unbalanced, it is expected that some kind of balanced-to-unbalanced transformer would be used.

Figure 6A:
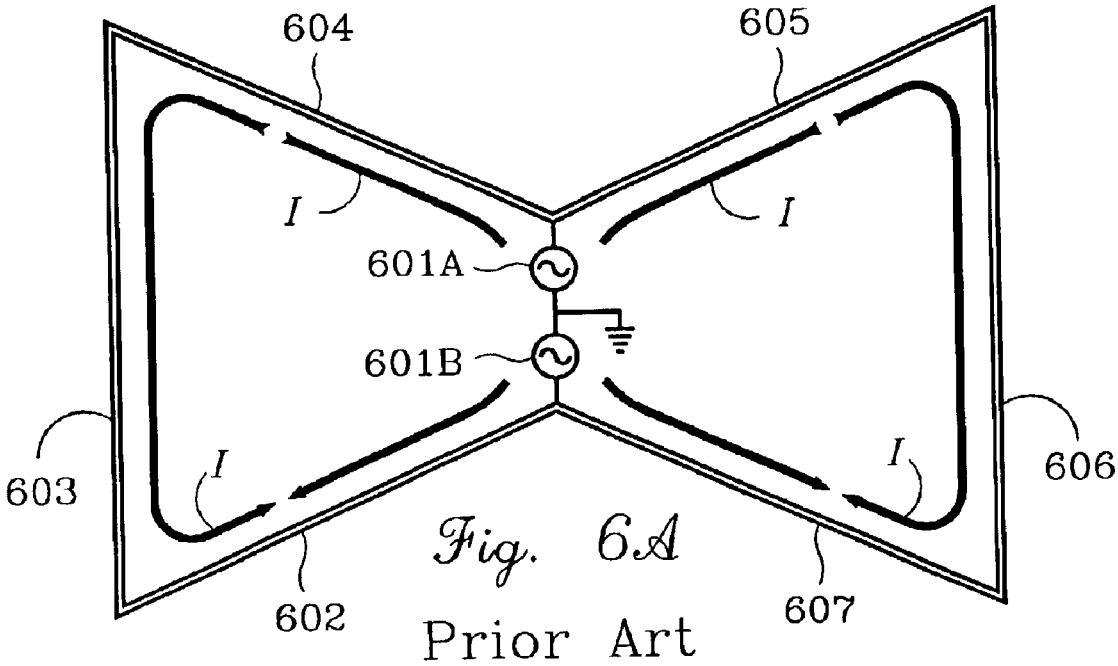
Fig. 6A Prior Art
FIGS. 6A, 6B and 6C illustrate a strengthened double-delta antenna element.
Figure 6B:
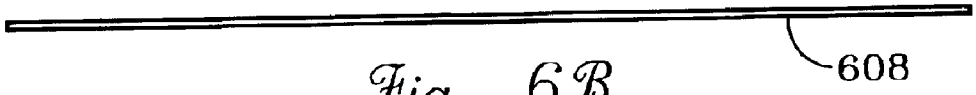
Fig. 6B Prior Art
Figure 6C:
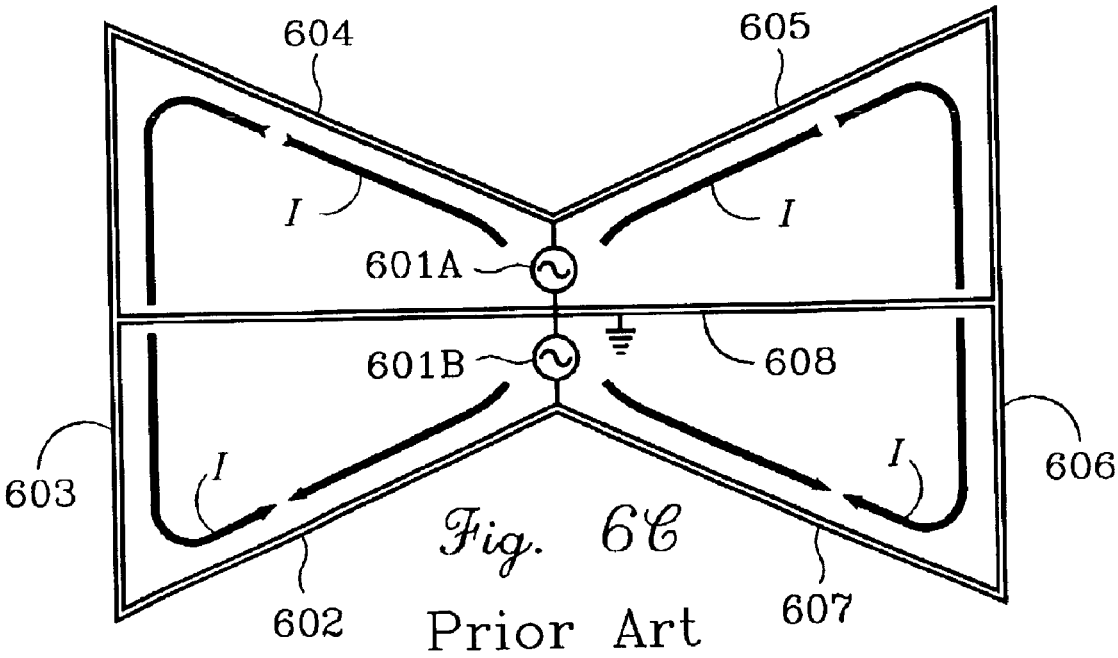
Fig. 6C Prior Art

Some designers have used only one-half of the T matching system illustrated by FIG. 17 to match double-delta antenna elements as in FIG. 6A. That is, they would use, for example, parts 1717, 1718, 1721, and 1722, but not parts 1719, 1720, 1723, and 1724, and they would make the connection to the antenna element with coaxial cable. Such a system ignores the fact that conductors carrying radio-frequency currents are not grounded just because they are connected to a ground point several wavelengths away. Such a system will not necessarily ground the center of the element, and currents probably will flow from that center point to ground via any convenient conductor such as the supporting tower. Such currents, although small, may significantly increase the radiation in undesired directions.

If it were necessary to use just one-half of the matching system, there should still be a balance. That is, it would be better to use, for example, just parts 1717, 1721, 1720, and 1724. Of course, a balanced-to-unbalanced transformer would still be appropriate to connect to an unbalanced transmission line.

The Invention—Strengthening Conductors

An additional feature illustrated by FIGS. 16, 17, 18, and 22 is the strengthening conductors, 1628, 1726, 1817, 2223, 2246, 2269, 2292, 2315, and 2338. Such additional conductors could be used if the antenna elements were symmetrical about the imaginary lines through their centers, which are perpendicular to the parallel conductors, and if the antenna elements were fed in a balanced manner around those imaginary lines. As it is with the double-delta antenna element of FIG. 6C, the voltages must be equal in magnitude and opposite in phase in conductors equidistant from the generator, via the conductors, and on opposite sides of the antenna elements. Therefore, in the single parallel crossing conductors, the voltages at the centers must be zero volts. Hence, as far as the connection is concerned, the grounded centers of the generator systems may be connected to the outer points of the antenna elements and to the centers of all the single crossing conductors. Also, the currents at corresponding points in conductors on either side of the antenna element will be equal in magnitude and opposite in phase, so their radiation to any conductors on the imaginary center lines will cancel. Therefore, no current will flow in such strengthening conductors either by the connection or by radiation from the other conductors.

Note that this is not necessarily true at the places where pairs of conductors cross but do not touch. It is because there is a connection in the centers that the voltages at the centers of single crossing conductors must be equal and opposite to themselves and, therefore, must be zero volts. Hence, to avoid changing the antenna element, the pairs of crossing conductors should be insulated from any strengthening conductors and from each other. Also, that is why a strengthening conductor for the quadruple-lemniscate antenna element of FIG. 11 would be connected only at the center of the element and at the outside loops.

Figure 18:
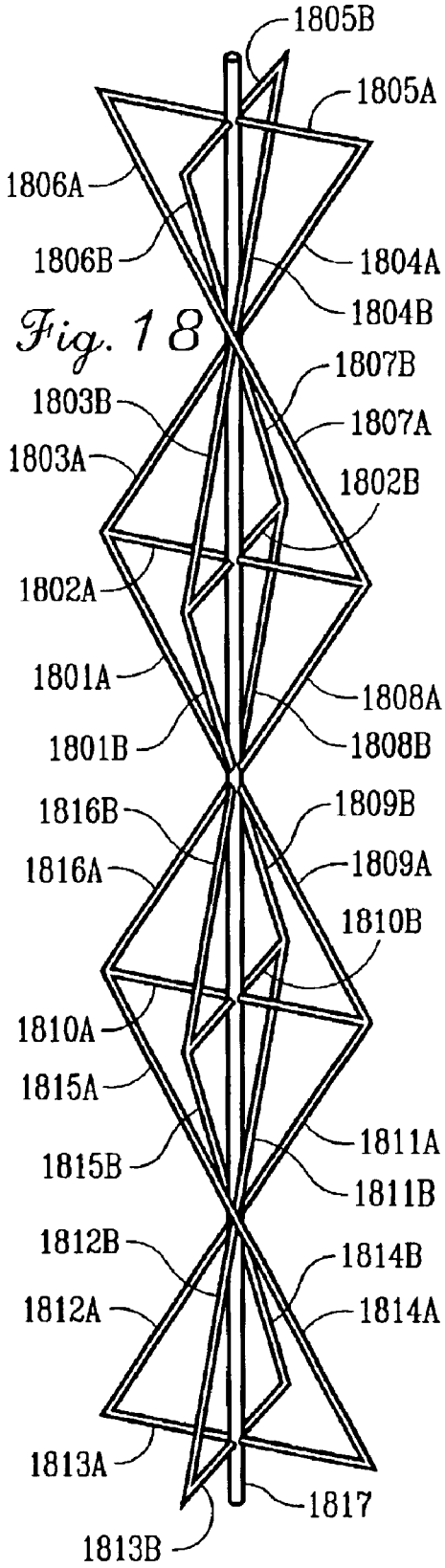
FIG. 18 illustrates a perspective view of a turnstile array of two strengthened sextuple-delta elements with single crossing conductors.

The strengthening conductors are particularly convenient with turnstile arrays, as in FIG. 18, and log-periodic arrays, as in FIG. 22. With turnstile arrays, the strengthening conductor can be just the mast that is supporting the antenna, so it is not really an extra conductor. As explained below, the strengthening conductor solves the problem of how to ground a whole log-periodic array and how to avoid supporting significant weight with insulators.

Because antennas usually are supported at their centers, it is logical that the conductors with the greatest strength will be at the centers. These conductors must support themselves and the conductors farther from the center. For example, the outer lemniscate loops in FIG. 16, 1606 and 1614, are illustrated as small diameter rods. This is logical because they are supporting only themselves and because rods usually are less expensive than tubes in small sizes. However, the use of strengthening conductors can modify this pattern of conductor strengths. In FIG. 16, the centers of parts 1604 and 1612 are secondary support points because they are connected to the central supporting conductor. That is, because of the strength of the parallel conductors, the diagonal conductors closer to the center, such as 1603 or 1611, can be weaker than parts 1604 and 1612. This kind of distribution of mechanical strength also is illustrated by FIG. 17.

This kind of antenna element that has parallel conductors that are larger in diameter than the diagonal conductors also has an electrical advantage. In general, antennas have wider bandwidths if the conductors carrying the most current have the greatest cross-sectional dimensions, than if the reverse were true. That is, because the parallel conductors are the major radiating conductors, it is better to have them larger than the diagonal conductors than to have the reverse relationship.

APPLICATIONS

Applications—Turnstile Arrays

These antenna elements can be used in the ways that dipoles are used. That is, they can be put into arrays to produce better antennas. For example, to make an omnidirectional radiation pattern, a turnstile array of dipoles has been used. That is, two dipoles are arranged in the form of a cross in a horizontal plane and fed 90 degrees out of phase with each other. FIG. 18, with parts 1801A to 1816A, 1801B to 1816B, and 1817 illustrates the corresponding arrangement of sextuple-delta antenna elements with single crossing conductors. The feeding arrangement is not shown because it would be conventional and would unnecessarily confuse the diagram.

These large antenna elements that extend in one direction are particularly appropriate for this kind of array. For one thing, these elements compress the H-plane radiation pattern, which is the vertical pattern in this orientation, but the E-plane radiation pattern is rather broad. That broad horizontal radiation pattern would be a disadvantage in some arrays but, fortunately, it produces a fine omnidirectional pattern in a turnstile array. The expanded designs have narrower horizontal patterns, so it may be necessary to use three elements arranged and phased at 60 degree angles to obtain a good omnidirectional pattern. However, if there were a need to have more radiation in some directions than in others without having a highly directional pattern, expanded antenna elements in a turnstile array might be most convenient.

These turnstile arrays can be very desirable. First, they can be very rugged. Antenna elements with single crossing conductors allow several strong mechanical connections to the mast. Furthermore, the expanded designs eliminate the need to bend the diagonal conductors away from the mast because the diagonal conductors do not cross the center of the element. In addition, some of these elements seem to be capable of very wide bandwidths. And lastly, if more gain were needed, the array could be expanded up and down while still having only one feed point with one set of matching components. Of course, more than one turnstile array could be stacked vertically, if that were desired.

Applications—Collinear and Broadside Arrays

Another application of these antenna elements arises from observing that half-wave dipoles traditionally have been positioned in the same plane either end-to-end (collinear array), side-by-side (broadside array), or in a combination of those two arrangements. Often, a second set of such dipoles, called reflectors or directors, is put into a plane parallel to the first one, with the dimensions chosen to produce a somewhat unidirectional pattern of radiation. Sometimes antenna elements are placed in front of reflecting screens, like part 1725 in FIG. 17. Such arrays have been used on the high-frequency bands by short-wave broadcast stations, on very-high-frequency bands for television broadcast reception, and by radio amateurs.

Hereinafter in this description and the attached claims, the front end of an antenna will be the end pointing in the direction of the desired radiation. The rear end of an antenna will be the end opposite from the front end.

These traditional definitions of what constitutes a collinear array or a broadside array of dipoles do not serve the purpose with the curved conductors of lemniscate loops. For example, what would be an end-to-end alignment if there were no ends? Instead, it is a more general definition to specify the alignments in terms of the E and H fields. In those terms, a collinear array would have the elements aligned in the direction of the E field. Likewise, the broadside array could be defined as having the elements aligned in the direction of the H field.

Figure 19:
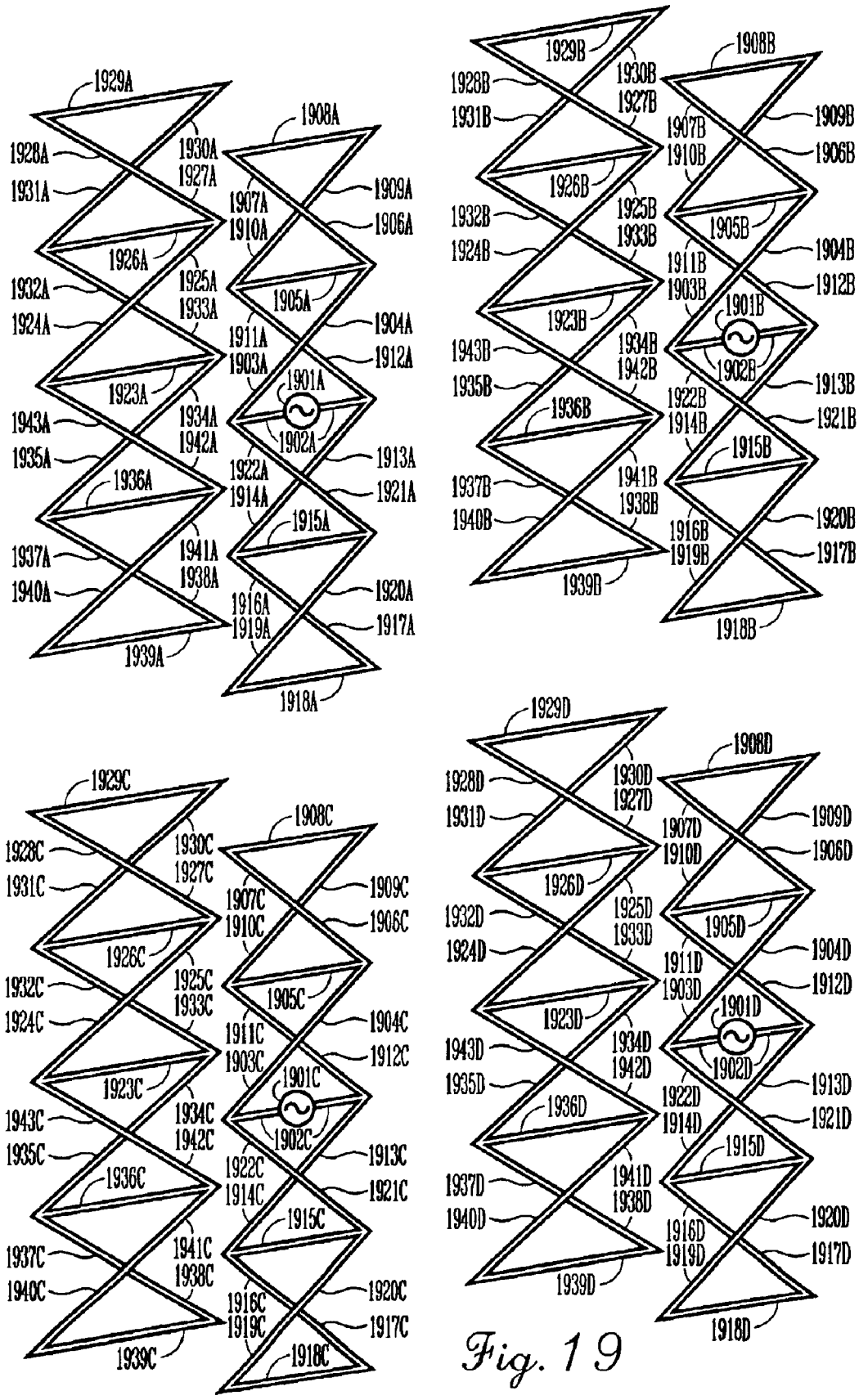
FIG. 19 illustrates a perspective view of an array of octuple-delta antenna elements with single crossing conductors to show the broadside and collinear arrays.

The collinear and broadside arrays can be used with the antenna elements of this disclosure, as FIG. 19 shows with expanded octuple-delta antenna elements with single crossing conductors. The array having parts 1901A to 1943A is in a collinear arrangement with the array having parts 1901B to 1943B, because they are aligned in the direction of the E field. That is, the parallel conductors are positioned end-to-end. The array having parts 1901C to 1943C and the array having parts 1901D to 1943D are similarly positioned. The A array is in a broadside arrangement with the C array, because they are aligned in the direction of the H field. The B array and the D array are similarly positioned.

Perhaps the main advantage of using the antenna elements of this disclosure rather than dipoles in such arrays is the less complicated system of feeding the array for a particular overall array size. That is, each of these antenna elements would perform in such an array as well as several half-wave dipoles.

Sometimes collinear or broadside arrays of dipoles have used unequal distributions of energy between the dipoles to reduce the radiation in undesired directions. Since the antenna elements of this disclosure reduce such undesired radiation anyway, there would be less need to use unequal energy distributions in equivalent arrays to achieve the same kind of result. Nevertheless, if such an unequal energy distribution were used, it should be less complicated to implement because of the less complicated feeding system.

Applications—Nonlinear Polarization

Yet another application of these antenna elements concerns nonlinear polarization. For communications with satellites or for communications on earth through the ionosphere, the polarization of the signal may be elliptical.

In such cases, it may be advantageous to have both vertically polarized and horizontally polarized antennas. They may be connected together to produce a circularly polarized antenna, or they may be connected separately to the associated electronic equipment for a polarity diversity system. Also, they may be positioned at approximately the same place or they may be separated to produce both polarity diversity and space diversity.

Figure 20:
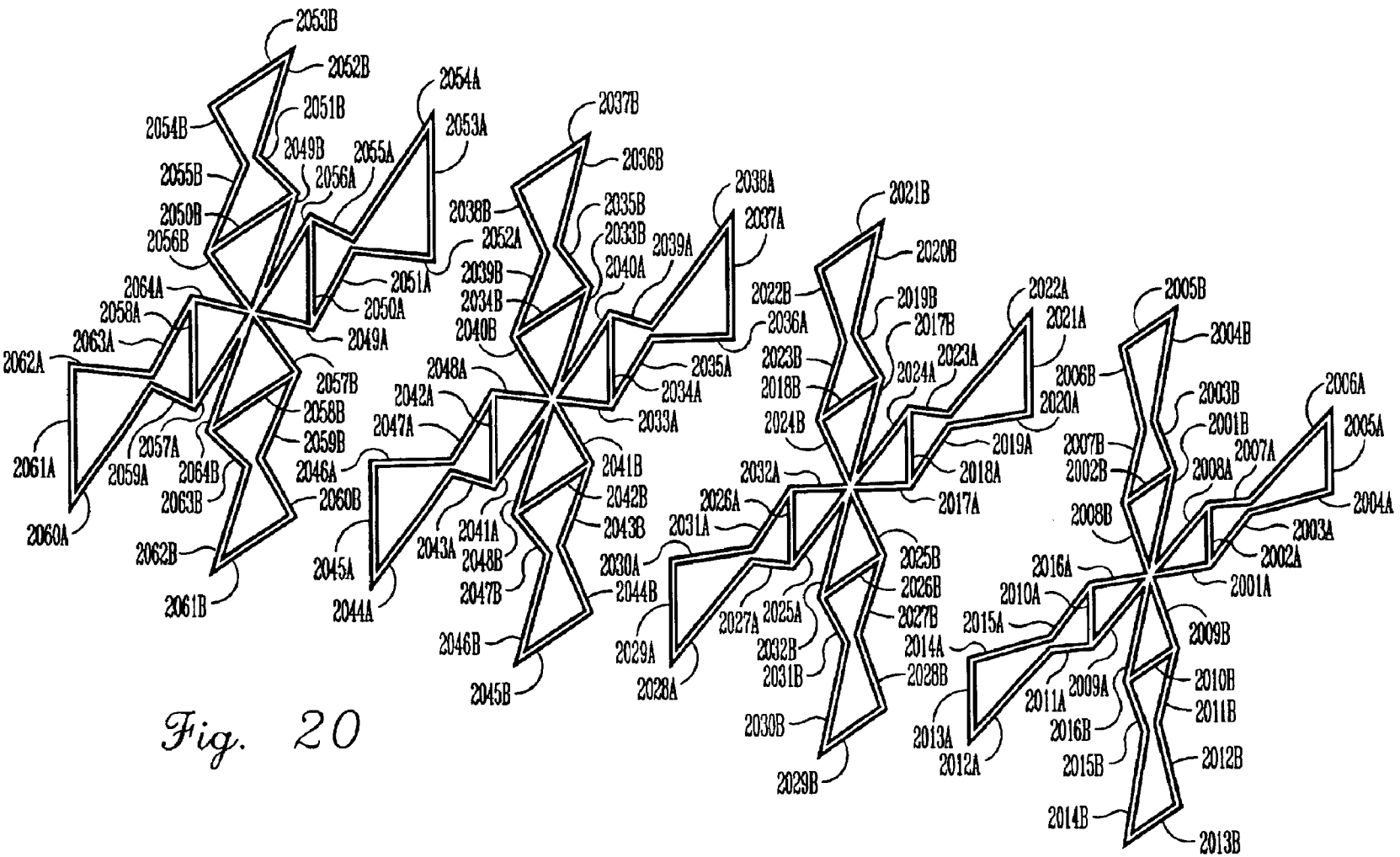
FIG. 20 illustrates a perspective view of an elliptically polarized array of expanded sextuple-delta antenna elements with single crossing conductors.

FIG. 20 illustrates an array of expanded sextuple-delta antenna elements with single crossing conductors for achieving this kind of performance. Parts 2001A to 2064A form a vertically polarized array and parts 2001B to 2064B form a horizontally polarized array. If the corresponding antenna elements of the two arrays were approximately at the same positions along the supporting boom, as in FIG. 20, the phase relationship between equivalent parts in the two arrays usually would be about 90 degrees for approximately circular polarization. If the corresponding antenna elements of the two arrays were not in the same position on the boom, as is common with similar half-wave dipole arrays, some other phase relationship would be used because the difference in position plus the difference in phase could produce the 90 degrees for circular polarization. It is common with half-wave dipole arrays to choose the positions on the boom such that the two arrays can be fed in phase and still achieve circular polarization.

However, one should not assume that this choice of position on the boom and phasing does not make a difference in the radiation produced. If two half-wave dipoles were positioned at the same place and were phased 90 degrees, there would tend to be a maximum of one polarity toward the front and a maximum of the other polarity toward the rear. For example, there may be a maximum of right-hand circular polarized radiation to the front and a maximum of left-hand circular polarized radiation to the rear. In the same example, there would be a null, ideally, of left-hand radiation to the front and a null of right-hand radiation to the rear. An equivalent array that produces the phase difference entirely by having the two dipoles in different positions on the boom would perform differently. Depending on how it was connected, it could have maxima of left-hand radiation to the front and rear. In such a case, the right-hand radiation would have maxima to the side and minima to the front and rear.

Of course, such arrays of individual dipoles would perform differently from arrays of the antenna elements of this disclosure. Also, if these antenna elements were put into larger arrays, the patterns would change some more. Nevertheless, one should not assume that the choice of using phasing or positions on the boom to achieve circular polarization does not change the antenna performance. One must make the choice considering what kind of performance is desired for the particular application.

Although this arrangement of antenna elements usually is chosen to produce circularly polarized radiation, one also should note that a phase difference of zero degrees or 180 degrees will produce linear polarization. As the array is shown in FIG. 20, those linear polarizations would be at a 45-degree angle to the earth, which probably would not be desired. It probably would be more desirable to rotate the array around the direction of the axes of the triangles by 45 degrees to produce vertical or horizontal polarization. With such an array, it would be possible to choose vertical polarization, horizontal polarization, or either of the two circular polarizations by switching the amount of phase difference applied to the system. Such a system may be very useful to radio amateurs who use vertical polarization for frequency modulation, horizontal polarization for single sideband and Morse code, and circular polarization for satellite communication on very-high-frequency and ultra-high-frequency bands. It also could be useful on the high-frequency bands because received signals can have various polarities.

Applications—Yagi-Uda Arrays

Figure 21:
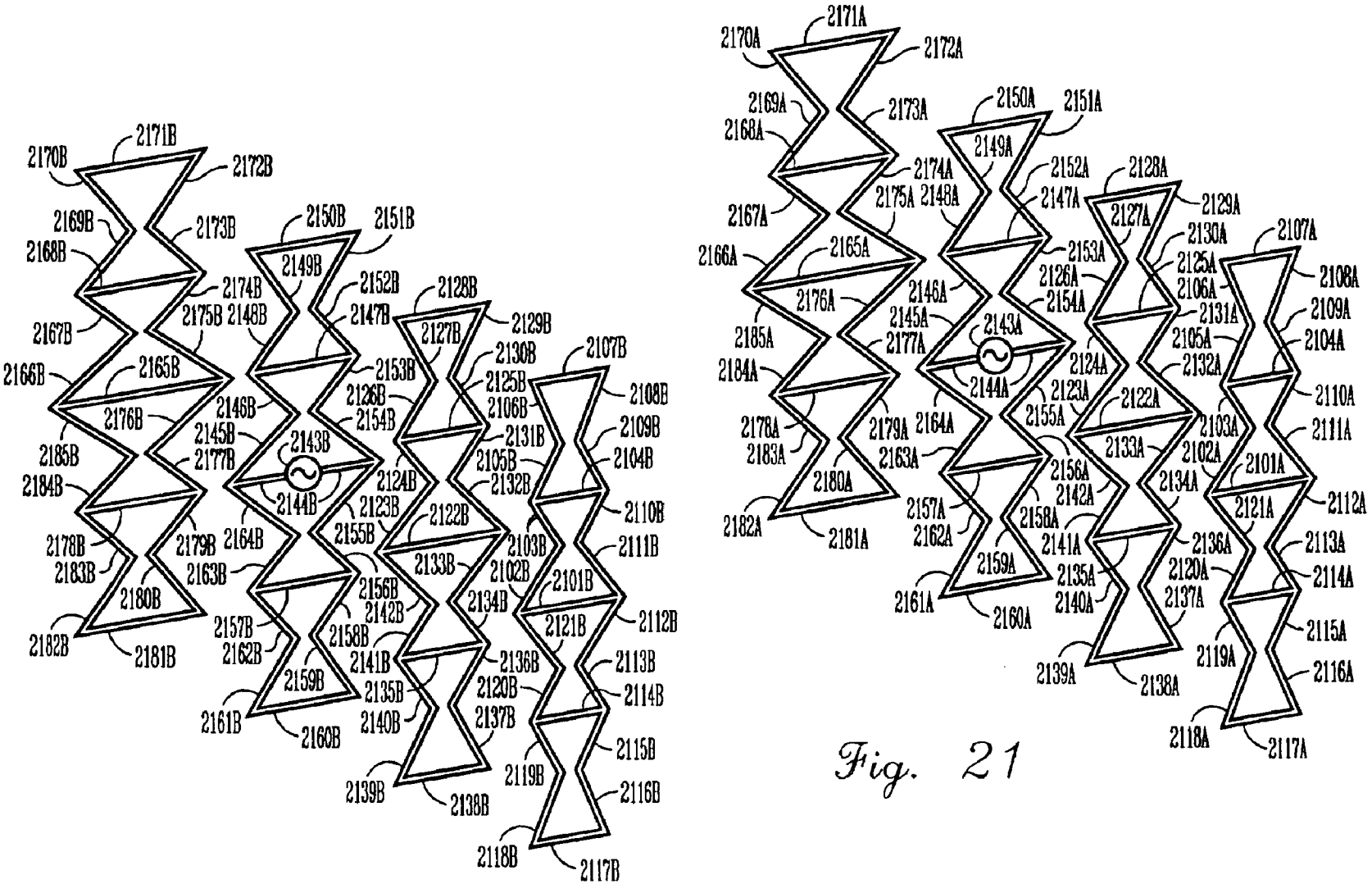
FIG. 21 illustrates a perspective view of a collinear array of two Yagi-Uda arrays of expanded octuple-delta antenna elements with single crossing conductors.

Yet another application, commonly called an end-fire array, has several antenna elements positioned so that they are in parallel planes and the principal H plane of each element is parallel to the principal H planes of the other elements. One antenna element, some of them, or all of them could be connected to the associated electronic equipment. If the second antenna element from the rear were so connected, as in FIG. 21, and the dimensions produced the best performance toward the front, it could logically be called a Yagi-Uda array of expanded octuple-delta antenna elements with single crossing conductors. FIG. 21 illustrates two such Yagi-Uda arrays in a collinear arrangement: parts 2101A to 2185A forming one of them and parts 2101B to 2185B forming the other one. Hereinafter the antenna elements having the generator symbols, 2143A and 2143B, will be called the driven elements; the elements to the rear, with parts 2165A to 2185A and parts 2165B to 2185B, will be called the reflector elements; and the remaining elements will be called the director elements. This terminology is conventional with the traditional names for dipoles in Yagi-Uda arrays. Another less popular possible array would be to have just two such elements with the rear one connected, called the driven element, and the front one not connected, called the director element.

The tactic for designing a Yagi-Uda array is to employ empirical methods rather than equations. This is partly because there are many combinations of dimensions that would be satisfactory for a particular application. Fortunately, there are computer programs available that can refine designs if reasonable trial designs are presented to the programs. That is as true of arrays of these antenna elements as it is for dipole arrays. To provide a trial design, it is common to make the driven element resonant near the operating frequency, the reflector element resonant at a lower frequency, and the director elements resonant at progressively higher frequencies from the rear to the front. Then the computer program can refine those trial dimensions.

The use of the antenna elements of this disclosure in such an array differs in two respects from the use of dipoles. Since the radiation pattern in the principal H plane can be changed, that is something to choose. A pattern like that of FIG. 1B may be chosen to suppress the radiation in undesired directions. The second factor is that in arrays that have these antenna elements aligned from the front to the rear, one should remember that the major radiating conductors preferably should be aligned to point in the direction of the desired radiation, perpendicular to the planes of the individual antenna elements. That is somewhat important in order to achieve the maximum gain, but it is more important in order to suppress the radiation in undesired directions. Therefore, when the resonant frequencies of the elements must be unequal, the widths of the elements should be chosen so that the perpendicular distances between the corresponding major radiating conductors of different elements are approximately equal. That is, the distances between the major radiating conductors preferably should be chosen to get the desired pattern in the principal H plane, and the widths of the elements should be chosen to achieve the other goals, such as the desired gain.

Applications—All-Driven Arrays

There are several possibilities for all-driven end-fire arrays but, in general, the mutual impedances make such designs rather challenging and the bandwidths can be very small. The log-periodic array, as illustrated by FIG. 22, is a notable exception. A smaller, feasible all-driven array would be just two identical antenna elements that are fed 180 degrees out of phase with each other. The space between the antenna elements would not be critical, but one-eighth of a wavelength would be a reasonable value. This would be similar to the dipole array disclosed by John D. Kraus in his article "A Small But Effective 'Flat Top' Beam" in *Radio* of March 1937, p. 56, which is commonly called a W8JK array, after his amateur-radio call letters. Since the impedances of the two antenna elements are equal when the phase difference is 180 degrees, it is relatively easy to achieve an acceptable bidirectional antenna by applying such tactics. If a balanced transmission line were used, the conductors going to one element simply would be transposed. For coaxial cable, an extra electrical half wavelength of cable going to one element might be a better device to provide the desired phase reversal.

If the space were available, such a bidirectional array of the antenna elements of this disclosure could be very desirable in the high-frequency spectrum where rotating antennas may not be practicable because they are very large. Particularly, a W8JK array of half sextuple-delta or octuple-delta antenna elements with single crossing conductors, like the one in FIG. 15, could be very useful.

Another possibility is two antenna elements spaced and connected so that the radiation in one direction is almost canceled. An apparent possibility is a distance between the antenna elements of a quarter wavelength and a 90-degree phase difference in their connection. Other space differences and phase differences to achieve unidirectional radiation will produce more or less gain, as they will with half-wave dipoles.

Applications—Log-Periodic Arrays

A log-periodic array of these antenna elements would be similar to the log-periodic dipole antenna disclosed by Isbell in his U.S. Pat. No. 3,210,767 entitled Frequency Independent Unidirectional Antennas. Log-periodic arrays of half-wave dipoles are used in wide-band applications for military, diplomatic and amateur radio purposes, as well as for the reception of television broadcasting. The merit of such arrays is a relatively constant impedance at the terminals and a reasonable radiation pattern across the design frequency range. However, this is obtained at the expense of gain. That is, their gain is poor compared to narrow band arrays of similar lengths. Although one would expect that gain must be traded for bandwidth in any antenna, it is nevertheless disappointing to learn of the low gain of such relatively large arrays.

If one observed the radiation pattern of a typical log-periodic dipole array in the principal E plane, it would appear to be a reasonable pattern of an antenna of reasonable gain because the major lobe of radiation would be reasonably narrow. However, the principal H plane would have a considerably wide major lobe that indicates poor gain. This poor performance in the principal H plane is caused, of course, by the use of half-wave dipoles. Because half-wave dipoles have circular radiation patterns in the principal H plane, they do not help the array to produce a narrow major lobe of radiation in that plane.

The antenna elements of this disclosure are well suited to improve the log-periodic array because they can be designed to suppress the radiation 90 degrees away from the center of the major lobe, as in FIG. 1B. That is, for a horizontally polarized log-periodic array, as in FIG. 22, the radiation upward and downward can be suppressed. However, since the overall array of parts 2201 to 2342 has octuple-delta antenna elements with single crossing conductors of various sizes, several of which are used at any particular frequency, it is overly optimistic to expect that the radiation from the array in those directions will be suppressed as well as it can be from a single antenna element operating at one particular frequency. Nevertheless, the reduction of radiation in those directions and, consequently, the improvement in the gain can be very significant.

The expanded versions of these antenna elements may not be appropriate for log-periodic arrays. This is because the relationship between the impedances of the elements is important to the operation of the antenna, and the log-periodic system is designed for series-resonant elements. That is, it is assumed that below the resonant frequency the impedance will be capacitive, above resonance the impedance will be inductive, and the resistive component will have a minimum at resonance. Because the expanded antenna elements may be closer to parallel resonance than to series resonance, the impedance may not be compatible with the log-periodic system. However, it is always possible that a system may be devised to use these elements in a log-periodic type of array. Also, expanded antenna elements that are series resonant can be produced, but they may not suppress the minor radiation lobes very well.

A difficulty with traditional log-periodic arrays is that the conductors that are feeding the various elements in the array also are physically supporting those elements. In FIG. 22, they are parts 2339 and 2340. Hereinafter in this description and the attached claims, those conductors will be called the feeder conductors. Those traditional arrays require, first of all, that the feeders must not be grounded. Therefore, the feeder conductors must be connected to the supporting mast by insulators. Not only is this undesirable because insulators usually are weaker than conductors, but it also is undesirable because it would be preferable to have the antenna grounded for direct currents for some measure of lightning protection. Another difficulty is that the characteristic impedance between the feeder conductors should be rather high for proper operation. Because the impedance depends on the ratio of the spacing to the conductor diameters, the large size of the feeder conductors needed for mechanical considerations requires a wide spacing between these conductors to obtain the desired impedance. That, consequently, requires supporting insulators between the feeder conductors that are longer than would be desired.

The common method of constructing log-periodic arrays is to support the antenna elements by insulators connected to a grounded boom instead of using strong feeder conductors. Then the connections between the elements are made with a pair of wires that cross each other between the adjacent elements. Not only is such a system undesirable because the elements are supported by insulators, but also it is undesirable because the feeder conductors do not have a constant characteristic impedance. Nevertheless, many people seem to be satisfied with this compromise.

Because the strengthened versions of these antenna elements are supported by metal conductors (2223, 2246, 2269, 2292, 2315, and 2338) that are attached with metal clamps to the grounded boom (2341), they offer particular benefits in log-periodic arrays. Since the loops are supported by the strengthening conductors, the loop conductor cross-sectional areas can be relatively small. Likewise, since the feeder conductors are merely connected to the loops, rather than supporting them, the feeder conductors can be small in cross-sectional area. Therefore, there is less need for wide spaces between the boom and the feeder conductors to achieve the required characteristic impedance. This reduces the length of the insulators holding the feeder conductors and reduces the strength required in those insulators. In addition, the whole array can be grounded for direct currents through the boom, mast and tower. Therefore, much of the mechanical problems of log-periodic arrays are solved by the use of strengthening conductors.

As was stated above, arrays that have these antenna elements aligned from the front to the rear, preferably should have their major radiating conductors aligned to point in the direction of the desired radiation, perpendicular to the planes of the individual elements. That is, the heights of the loops should be equal. That equal-height alignment usually is not a problem with Yagi-Uda arrays. This is partly because only one of the antenna elements in the array is connected to the associated electronic equipment, and partly because the range of frequencies to be covered usually is small enough that there is not much difference in the sizes of the antenna elements in the array. Therefore, it is preferable and convenient to have equal loop heights.

One problem with log-periodic arrays is that their purpose is to cover a relatively large range of frequencies. Therefore, the range of their dimensions is relatively large. It is not unusual for the resonant frequency of the largest element in a log-periodic array to be one-half of the resonant frequency of the smallest element. One result of this is that if one tried to achieve that range of resonant frequencies with a constant height, it would be likely that the appropriate height of the loops of the largest antenna element in the array for a desirable radiation pattern at the lower frequencies would be larger than the perimeters of the loops of the smallest antenna element. Hence, such an equal-height array would be practicable only if the range of frequencies covered were not very large.

Another reason for the problem is that all of the individual antenna elements are connected in a conventional log-periodic array. Therefore, the relationship between the impedances of the elements is important. The problem of equal-height log-periodic designs is that the impedances of high and narrow elements are quite different from the impedances of short and wide versions. The design of the connecting system, which depends on those impedances, might be unduly complicated if these unequal impedances were taken into account. In addition, the design might be complicated by the fact that the radiation pattern would change if the ratio of the height to width were changed. Therefore, instead of using equal heights, it may be preferable to accept the poorer gain and poorer reduction of radiation to the rear resulting from the nonaligned major radiating conductors in order to use antenna elements that are proportional to each other in height and width.

Sometimes, a compromise between the extremes of equal height and proportional dimensions is useful. For example, the resonant frequencies of adjacent antenna elements may conform to a constant ratio, the conventional scale factor, but the heights may conform to some other ratio, such as the square root of the scale factor.

Applications—Log-Periodic Design

Whether equal-height antenna elements or proportional dimensions are used, the design principles are similar to the traditional principles of log-periodic dipole arrays. However, the details would be different in some ways. The scale factor ($\tau$) and spacing factor ($\sigma$) usually are defined in terms of dipole lengths, but there would be no such lengths available if the elements were not half-wave dipoles. It is better to interpret the scale factor as the ratio of the resonant wavelengths of adjacent antenna elements. If the design were proportional, that also would be the ratio of any corresponding dimensions in the adjacent elements. For example, for the proportional array of FIG. 22, the scale factor would be the ratio of any dimension of the second largest antenna element formed by parts 2293 to 2315 divided by the corresponding dimension of the largest antenna element formed by parts 2316 to 2338. The spacing factor could be interpreted as the ratio of the individual space to the resonant wavelength of the larger of the two antenna elements adjacent to that space. For example, the spacing factor would be the ratio of the space between the two largest elements to the resonant wavelength of the largest element.

Some other standard factors may need more than reinterpretation. For example, since the impedances of the antenna elements of this disclosure do not equal the impedances of dipoles, the usual impedance calculations for log-periodic dipole antennas are not very useful. Also, since the array uses some antenna elements that are larger and some that are smaller than resonant elements at any particular operating frequency, the design must be extended to frequencies beyond the operating frequencies. For log-periodic dipole antennas, this is done by calculating a bandwidth of the active region, but there is no such calculation available for log-periodic arrays of the antenna elements of this disclosure. Since the criteria used for determining this bandwidth of the active region were quite arbitrary, this bandwidth may not have satisfied all the uses of log-periodic dipole antennas either.

However, if the array had a constant scale factor and a constant spacing factor, the elements were connected with a transmission line having a velocity of propagation near the speed of light, like open wire, and the connections were reversed between each pair of elements, the result would be some kind of log-periodic array. In FIG. 22, that transmission line is formed by the two feeder conductors 2339 and 2340. The connection reversal is achieved by alternately connecting the left and right central conductors to the top and bottom feeder conductors. For example, the left central conductor of the largest antenna element, 2317, is connected to the bottom feeder conductor, 2340, but the left central conductor of the second largest antenna element, 2294, is connected to the top feeder conductor, 2339. The frequency range, the impedance, and the gain of such an array may not be what the particular application requires but, nevertheless, it still would be a log-periodic array. The task is just to start with a reasonable trial design and to make adjustments to achieve an acceptable design.

This approach is practicable because computer programs allow us to test antennas before they exist. No longer is it necessary to be able to calculate the dimensions with reasonable accuracy because of the cost of building real antennas. Instead, the trial dimensions could be put into a computer spreadsheet, so that the mechanical results of changes could be seen almost instantly. If the results of those mechanical calculations seemed promising, an antenna simulating program could show whether the design were electrically acceptable to a reasonable degree of accuracy. Only after the computer testing had produced a reasonable design, would it be necessary to build real antennas for testing on the antenna range.

To get a trial log-periodic design, the procedure could be as follows. The known specifications would be the band of frequencies to be covered, the desired gain, the desired reduction of radiation to the rear, the desired length of the array, and the number of antenna elements that could be tolerated because of the weight and cost. Since the resonant frequencies of the largest and smallest antenna elements could not be calculated, it would be necessary just to choose a pair of frequencies that would be reasonably beyond the actual operating frequencies. Then, given the minimum frequency ($f_{min}$) maximum frequency ($f_{max}$) length (L), and number of elements (N), one could calculate the scale factor ($\tau$) and the spacing factor ($\sigma$) by using the geometry of the array.

$$\tau=(f_{min}/f_{max})^{[1/N-1)]}$$

The calculation of $\sigma$ requires the calculation of the wavelength of the largest antenna element. Of course, this could be done in any units, but this maximum wavelength and the length of the array must be in the same units.

$$\lambda_{max}=9.84\times10^8/f_{min} \text{ ft or}$$

$$\lambda_{max}=3\times10^8/f_{min\ m}$$

$$\sigma=[L(1-\tau)]/[\lambda_{max}(1-f_{min}/f_{max})]$$

Once an acceptable mechanical design was revealed by these calculations, it would be tested for electrical performance by an antenna simulating program. The largest antenna element would be designed using the maximum wavelength ($\lambda_{max}$). Then, for a proportional design, the resonant wavelengths and dimensions of the remaining antenna elements would be obtained by successively multiplying the wavelengths and the dimensions by the scale factor. The spaces between the antenna elements would be obtained by multiplying the wavelength of the larger adjacent antenna element by the spacing factor. An additional factor needed for the program would be the distance between the feeder conductors. For good operation this distance should produce a relatively high characteristic impedance. Unless the scale factor were rather high, a minimum characteristic impedance of 200 ohms perhaps would be prudent. Because the boom (2341) is a part of the feeding system in FIG. 22, that criterion would be at least 100 ohms between either feeder conductor and the boom.

The gain, front-to-back ratio, and standing wave ratio of this first trial design probably would indicate that the upper and lower frequencies were not acceptable. At least, the spacing between the feeder conductors probably should be modified to produce the best impedance across the band of operating frequencies. With this information, new values would be chosen to get a second trial design.

What is an acceptable performance is, of course, a matter of individual requirements and individual standards. For that reason, variations from the original recommended practice are common. For example, although an extension of the feeder conductors behind the largest element was recommended in early literature to improve the performance at the lowest frequency, it is seldom used. The original recommendation was that it should be about an eighth of a wavelength long at the lowest frequency and terminated in the characteristic impedance of the feeder conductors, which is represented by the resistance symbol 2342. It is more common practice to make the termination a short circuit. If the antenna were designed for proper operation, the conventional wisdom seems to be that the current in the termination would be very small anyway, so the termination would do very little and usually could be eliminated. However, there are some reports that the performance at twice the lowest frequency would be impaired if the extension were not used.

Actually, extending or not extending the feeder conductors may not be the significant choice. There may be a limit to the length of the antenna. In that case, the choice may be whether it is better to have an extension or more antenna elements without an extension. Note that because the boom is a part of the feeding system in FIG. 22, it should be extended as well if the same impedance were desired.

Various other methods for improving designs that are too short for proper log-periodic operation also are used. They include scale factors or spacing factors that vary along the length of the boom, varying impedances of the feeding conductors, and extensions that have impedances that are different from the impedances of the feeding conductors. Such methods could be very useful if only specific parts of the frequency spectrum of the antenna were actually used.

The log-periodic array of FIG. 22 illustrates the appropriate connecting points, F, to serve a balanced transmission line leading to the associated electronic equipment. Other tactics for feeding unbalanced loads and higher impedance balanced loads also are used with log-periodic dipole antennas. Because these tactics depend only on some kind of log-periodic array connected to two parallel tubes, these conventional tactics are as valid for such an array of these antenna elements as they are for such arrays of half-wave dipoles.

Applications—Large Arrays

Both Yagi-Uda arrays and log-periodic arrays of these antenna elements can be used in the ways that such arrays of half-wave dipoles are used. For example, FIG. 20 shows two end-fire arrays that are oriented to produce elliptically polarized radiation. For another example, FIG. 21 shows two Yagi-Uda arrays oriented so that the corresponding antenna elements of the two arrays are in approximately the same vertical planes. In this case, there is a side-by-side or collinear orientation, because the parallel conductors of one array are positioned end-to-end with the corresponding parts of the other array. The arrays also could be oriented one above the other (broadside), or several arrays could be arranged in both orientations.

Since the maximum possible gains of such large arrays tends to depend on the overall area of the array facing the direction of maximum radiation, it is unrealistic to expect much of a gain advantage from using these antenna elements in large arrays of a particular overall size. However, there are other advantages. Since the individual arrays in the overall array could have more gain if they were composed of the antenna elements of this disclosure, the feeding system could be simpler because fewer individual arrays would be needed to fill the overall space adequately. In addition, the superior ability of these antenna elements to suppress received signals arriving from undesired directions is a considerable advantage when the desired signals are small. For communication by reflecting signals off the moon, the ability to suppress undesired signals and noise is a great advantage.

It is well known that there is some minimum spacing needed between the individual antenna elements in collinear or broadside arrays so that the gain of the whole antenna will be maximized. If the beam widths of the individual antenna elements were narrow, that minimum spacing would be larger than if the beam widths were wide. In other words, if the gains of the individual antenna elements were large, the spacing between them should be large. Large spacing, of course, increases the cost and weight of the supporting structure.

Because the half-wave dipole has no directivity in the principal H plane, Yagi-Uda arrays of half-wave dipoles usually have wider beam widths in the principal H plane than in the principal E plane. Therefore, the spacing necessary to obtain the maximum gain from two such arrays would be less for a broadside array than for a collinear array. That is, for a horizontally polarized array, it would be better from a cost and weight point of view to place the two arrays one above the other instead one beside the other. The antenna elements of this disclosure present the opposite situation. Because these antenna elements produce considerable directivity in the principal H plane, a Yagi-Uda array of them would have a narrower beam in the principal H plane than in the principal E plane. Therefore, it would be better to place two such arrays side-by-side, as in FIG. 21, rather than one above the other. Of course, mechanical or other considerations may make other choices preferable.

It also is unrealistic to expect that long Yagi-Uda arrays of these antenna elements will necessarily have large gain advantages over long Yagi-Uda arrays of half-wave dipoles. The principle of a minimum necessary spacing applies here as well. It is not exactly true, but one can consider that these antenna elements comprise several dipoles, represented by the major radiating conductors. Presented in that manner, a Yagi-Uda array of these antenna elements could be considered equivalent to a broadside array of several Yagi-Uda arrays of dipoles.

Each of these Yagi-Uda arrays would have some beam width in the principal H plane and, therefore, they should be separated by some minimum distance to produce the maximum gain for the combination. The longer the Yagi-Uda array is, of course, the narrower the individual H plane beams would be and the greater the spacing should be. That is, since the spacing is limited by the need to have loops of a particular size, a long Yagi-Uda array of these antenna elements would not have as much gain as one might expect. In particular, a very long array of these antenna elements may not have much advantage at all over an array of half-wave dipoles of the same length.

That situation raises the question of how long Yagi-Uda arrays should be. One factor is that there usually is an advantage to making Yagi-Uda arrays of four double-delta antenna elements because four elements usually are required to produce an excellent suppression of the radiation to the rear of the array. Beyond that array length, the increase in gain for the increase in length probably would be disappointing because the distance between the parallel conductors cannot be increased very much. That is, the usual expectation that doubling the length producing twice the gain would not be realized. It probably would be wiser to employ more than one Yagi-Uda array of double-delta antenna elements in a larger collinear or broadside array.

Because quadruple-delta antenna elements have more directivity in the principal H plane, a Yagi-Uda array of them can be longer before the advantage over a dipole array becomes too small. It depends on individual circumstances, but perhaps eight or ten quadruple-delta antenna elements in a Yagi-Uda array is a reasonable limit. If the antenna elements of this disclosure were used, even longer Yagi-Uda arrays should be worthwhile.

CONCLUSION

Except for the restrictions of size, weight, and cost, these antenna elements could be used for almost whatever purposes that antennas are used. Beside the obvious needs to communicate sound, pictures, data, etc., they also could be used for such purposes as radar or for detecting objects near them for security purposes. Since they are much larger than half-wave dipoles, it would be expected that they would generally be used at very-high and ultra-high frequencies. However, they may not be considered to be too large for short-wave broadcasting because that service typically uses very large antennas.

Also, the usual antenna materials could be used in these antennas. That is, not only the conventional aluminum but also more exotic materials that have been used in antennas, such as silver-plated steel or copper, would be acceptable.

While this invention has been described in detail, it is not restricted to the exact embodiments shown. These embodiments serve to illustrate some of the possible applications of the invention rather than to define the limitations of the invention.

I claim:

1. An antenna element comprising at least three pairs of conducting loops, the perimeters of said conducting loops being approximately 1 to 2 wavelengths, such that:

(a) all of said conducting loops are disposed approximately in the same plane;

(b) each of said pairs of conducting loops has a reference point;

(c) said reference points are disposed so that an imaginary straight line that approximately passes through said reference points is described;

(d) in each of said pairs of conducting loops, said conducting loops are disposed on opposite sides of said reference point;

(e) in each of said pairs of conducting loops, each of said conducting loops has at least one approximate corner that is disposed approximately at said reference point;

(f) each of said conducting loops is disposed approximately symmetrically around said imaginary straight line that approximately passes through said reference points;

(g) in each of said pairs of conducting loops, said conducting loops are generally wider at greater distances from said reference points;

(h) the sum of the heights of the two adjacent conducting loops disposed between each pair of adjacent reference points equals the distance between said pair of adjacent reference points;

(i) between each of said pairs of adjacent reference points, where said two adjacent conducting loops approach each other, except at the proximal point of said antenna element, one side of one of said adjacent conducting loops is connected to the opposite side of the remaining one of said adjacent conducting loops, and the two remaining sides of said adjacent conducting loops are connected to each other;

(j) in each of said pairs of conducting loops, approximately at each of said reference points, except at said proximal point of said antenna element, one side of one of said conducting loops is connected to one side of the remaining conducting loop, the two remaining sides of said conducting loops are connected to each other, but there is no connection between these two connections; and (k) there is a means for connecting an associated electronic equipment effectively in series with the two proximal conducting loops of said antenna element, approximately at the proximal point of said antenna element.

2. The antenna element of claim 1 wherein all of said perimeters of said conducting loops are approximately equal to each other.

3. The antenna element of claim 1 wherein at least one of said perimeters of said conducting loops is not equal to said perimeters of the rest of said conducting loops.

4. The antenna element of claim 1 wherein the dimensions of said antenna element are chosen to maximize the transmitting and receiving ability of said antenna element in the direction perpendicular to said plane of said antenna element.

5. The antenna element of claim 1 wherein the dimensions of said antenna element are chosen to minimize the transmitting and receiving ability of said antenna element in the two directions that are parallel to said imaginary straight line that approximately passes through said reference points.

6. The antenna element of claim 1 wherein the dimensions of said antenna element are chosen to produce a beneficial compromise between maximizing the transmitting and receiving ability of said antenna element in the direction perpendicular to said plane of said antenna element and minimizing said transmitting and receiving ability in other directions.

7. The antenna element of claim 1 wherein at least one of the conductors of said conducting loops has a circular cross-sectional area.

8. The antenna element of claim 1 wherein at least one of the conductors of said conducting loops has a solid cross-sectional area.

9. The antenna element of claim 1 wherein at least one of the conductors of said conducting loops has a tubular cross-sectional area.

10. The antenna element of claim 1 wherein the conductors of said conducting loops have approximately equal cross-sectional areas.

11. The antenna element of claim 1 wherein not all of the conductors of said conducting loops have equal cross-sectional areas.

12. The antenna element of claim 1 wherein:

(a) said perimeters of said conducting loops are approximately one operating wavelength; and (b) in each of said pairs of conducting loops, approximately at each of said reference points, except at said proximal point of said antenna element, one side of one of said conducting loops is connected to the opposite side of the remaining conducting loop and the remaining sides of said conducting loops are connected to each other, but there is no connection between these two connections.

13. The antenna element of claim 1 wherein:

(a) said perimeters of said conducting loops are approximately one and one-half to two operating wavelengths; and (b) in each of said pairs of conducting loops, approximately at each of said reference points, except at said proximal point of said antenna element, one side of one of said conducting loops is connected to the same side of the remaining conducting loop and the remaining sides of said conducting loops are connected to each other, but there is no connection between these two connections.

14. The antenna element of claim 1 wherein at least one of said conducting loops, of at least one of said pairs of conducting loops, is approximately such that the distance from said reference point of said pair of conducting loops to any point on said conducting loop is approximately equal to the expression $$r=h|\cos(m\theta)|^p$$

wherein:

(a) θ is the angle in said plane of said antenna element between an imaginary straight line from said reference point to said point on said conducting loop and said imaginary straight line that approximately passes through said reference points;

(b) θ has values between $-\pi/2m$ and $\pi/2m$ radians or values between $(\pi-\pi/2m)$ and $(\pi+\pi/2m)$ radians;

(c) m is a positive number greater than one;

(d) p is a non-negative number;

(e) h is the distance from said reference point to the outer point of said conducting loop; and (f) r is said distance from said reference point to said point on said conducting loop.

15. The antenna element of claim 14 wherein the shape of said conducting loop is approximately simulated by a series of approximately straight conductors.

16. The antenna element of claim 1 wherein the outer side of at least one of said conducting loops is an approximately straight conductor disposed approximately perpendicular to said imaginary straight line that passes approximately through said reference points.

17. The antenna element of claim 16 wherein at least one of said conducting loops is approximately triangular.

18. The antenna element of claim 16 such that:

(a) between at least one of said pairs of adjacent reference points, said outer sides of both of said adjacent conducting loops are approximately straight conductors disposed approximately perpendicular to said imaginary straight line that approximately passes through said reference points;

(b) said outer sides of said adjacent conducting loops have the same lengths; and (c) said outer sides of said adjacent conducting loops are connected throughout said outer sides so that the resulting approximately straight conductor is the common outer side of both of said adjacent conducting loops.

19. The antenna element of claim 1, further including an approximately straight strengthening conductor such that:

(a) said approximately straight strengthening conductor is disposed approximately at said imaginary straight line that approximately passes through said reference points;

(b) said approximately straight strengthening conductor may be connected to said conducting loops at the proximal point of said antenna element, at the distal points of said antenna element, and at any point where two of said adjacent conducting loops have common outer sides; and (c) except perhaps at said proximal point of said antenna element, said approximately straight strengthening conductor is not connected to said conducting loops at said reference points.

20. An antenna array, comprising at least two antenna elements, such that:

(a) each of said antenna elements comprises at least three pairs of conducting loops;

(b) said conducting loops have perimeters of approximately 1 to 2 wavelengths;

(c) in each of said antenna elements, all of said conducting loops are disposed approximately in the same plane;

(d) each of said pairs of conducting loops has a reference point;

(e) in each of said antenna elements, said reference points are disposed so that an imaginary straight line that approximately passes through said reference points is described;

(f) in each of said pairs of conducting loops, said conducting loops are disposed on opposite sides of said reference point;

(g) in each of said pairs of conducting loops, each of said conducting loops has at least one approximate corner that is disposed approximately at said reference point;

(h) each of said conducting loops is disposed approximately symmetrically around said imaginary straight line that approximately passes through said reference points;

(i) in each of said pairs of conducting loops, said conducting loops are generally wider at greater distances from said reference points;

(j) the sum of the heights of the two adjacent conducting loops disposed between each pair of adjacent reference points equals the distance between said pair of adjacent reference points;

(k) between each of said pairs of adjacent reference points, where said two adjacent conducting loops approach each other, except at the proximal point of said antenna element, one side of one of said adjacent conducting loops is connected to the opposite side of the remaining one of said adjacent conducting loops, and the two remaining sides of said adjacent conducting loops are connected to each other;

(l) in each of said pairs of conducting loops, approximately at each of said reference points, except at said proximal point of said antenna element, one side of one of said conducting loops is connected to one side of the remaining conducting loop, the two remaining sides of said conducting loops are connected to each other, but there is no connection between these two connection;

(m) the intersections of said planes of said antenna elements form a line of intersection that passes much nearer than the length of an operating wavelength to said imaginary lines that approximately pass through said reference points;

(n) the proximal points of said antenna elements are much nearer to each other than the length of an operating wavelength;

(o) except at said proximal points of said antenna elements, at the distal points of said antenna elements, or at the centers of any single crossing conductors, said antenna elements may not touch each other;

(p) means is provided to connect each of said antenna elements to an associated electronic equipment effectively in series with the two proximal conducting loops of said antenna element, approximately at said proximal point of said antenna element; and (q) said means also is such that the currents in the corresponding conductors of said antenna elements consistently are related in amplitude by approximately the same ratio of values and consistently are unequal in phase by approximately the same amount of phase.

21. The antenna array of claim 20 wherein:

(a) there are just two of said antenna elements in said antenna array; and (b) the angle between said planes of said antenna elements is approximately 90 degrees.

22. The antenna array of claim 21 wherein said means of connecting said two antenna elements to said associated electronic equipment also is such that the currents in said corresponding conductors, of said two antenna elements, are approximately equal in amplitude and are approximately a consistent 90 degrees out of phase with each other.

23. The antenna array of claim 20 wherein:

(a) there are just three of said antenna elements in said antenna array;

(b) the angles between said planes of said antenna elements are approximately 60 degrees;

(c) said means of connecting said antenna elements to said associated electronic equipment also is such that the currents in said corresponding conductors of said antenna elements are approximately equal in amplitude; and (d) said connecting means also is such that, progressing around said line of intersection of said antenna array in one particular direction, the pattern of the phases of the currents in said corresponding conductors is approximately zero, 60, 120, 180, 240 and 300 degrees.

24. An antenna system of at least one antenna array, each of said antenna arrays comprising at least one antenna element, such that:

(a) each of said antenna elements comprises at least three pairs of conducting loops;

(b) said conducting loops have perimeters of approximately 1 to 2 wavelengths;

(c) in each of said antenna elements, all of said conducting loops are disposed approximately in the same plane;

(d) each of said pairs of conducting loops has a reference point;

(e) in each of said antenna elements, said reference points are disposed so that an imaginary straight line that approximately passes through said reference points is described;

(f) in each of said pairs of conducting loops, said conducting loops are disposed on opposite sides of said reference point;

(g) in each of said pairs of conducting loops, each of said conducting loops has at least one approximate corner that is disposed approximately at said reference point;

(h) each of said conducting loops is disposed approximately symmetrically around said imaginary straight line that approximately passes through said reference points;

(i) in each of said pairs of conducting loops, said conducting loops are generally wider at greater distances from said reference points;

(j) the sum of the heights of the two adjacent conducting loops disposed between each pair of adjacent reference points equals the distance between said pair of adjacent reference points;

(k) between each of said pairs of adjacent reference points, where said two adjacent conducting loops approach each other, except at the proximal point of said antenna element, one side of one of said adjacent conducting loops is connected to the opposite side of the remaining one of said adjacent conducting loops, and the two remaining sides of said adjacent conducting loops are connected to each other;

(l) in each of said pairs of conducting loops, approximately at each of said reference points, except at said proximal point of said antenna element, one side of one of said pair of conducting loops is connected to one side of the remaining conducting loop, the remaining sides of said conducting loops are connected to each other, but there is no connection between these two connections;

(m) in each of said antenna arrays, said antenna elements are disposed in planes approximately parallel to each other;

(n) in each of said antenna arrays, said imaginary straight lines that pass through said reference points are parallel to each other;

(o) in each of said antenna arrays, said proximal points of said antenna elements are approximately aligned in the direction perpendicular to the planes of said antenna elements; and (p) in each of said antenna arrays, means is provided to connect at least one of said antenna elements to an associated electronic equipment effectively in series with the two proximal conducting loops of each of the connected antenna elements, approximately at said proximal points of said connected antenna elements.

25. The antenna system of claim 24, further including a reflecting screen disposed behind said antenna system to produce a substantially unidirectional transmitting and receiving ability to the front of said antenna system in the direction approximately perpendicular to said planes of said antenna elements.

26. The antenna system of claim 24 wherein there is only one of said antenna arrays in said antenna system.

27. The antenna system of claim 24 wherein there is more than one antenna array in said antenna system.

28. The antenna system of claim 27 wherein:

(a) said antenna elements, of all of said antenna arrays, are disposed so that their principal H planes are approximately parallel to each other; and (b) said antenna arrays are approximately aligned in the direction parallel to the planes of said antenna elements and perpendicular to said principal H planes of said antenna elements.

29. The antenna system of claim 27 wherein:

(a) said antenna elements, of all of said antenna arrays, are disposed so that their principal H planes are approximately parallel to each other; and (b) said antenna arrays are approximately aligned in the direction parallel to the planes of said antenna elements and parallel to said principal H planes of said antenna elements.

30. The antenna system of claim 27 wherein:

(a) said antenna elements, of all of said antenna arrays, are disposed so that their principal H planes are approximately parallel to each other; and (b) said antenna arrays are approximately aligned in the direction parallel to the planes of said antenna elements and aligned both in the direction parallel to and in the direction perpendicular to said principal H planes of said antenna elements, thereby producing a rectangular antenna system.

31. The antenna system of claim 27 wherein the relative amplitude and phase of the currents in said antenna arrays and the distances between said antenna arrays are chosen to maximize the transmitting and receiving ability to the front of said antenna system.

32. The antenna system of claim 27 wherein the relative amplitude and phase of the currents in said antenna arrays and the distances between said antenna arrays are chosen to minimize the transmitting and receiving ability in directions other than to the front of said antenna system.

33. The antenna system of claim 27 wherein the relative amplitude and phase of the currents in said antenna arrays and the distances between said antenna arrays are chosen to produce a beneficial compromise between maximizing the transmitting and receiving ability to the front of said antenna system and minimizing said transmitting and receiving ability in other directions.

34. The antenna system of claim 24 wherein there is only one of said antenna elements in each of said antenna arrays.

35. The antenna system of claim 24 wherein there is more than one of said antenna elements in each of said antenna arrays.

36. The antenna system of claim 35 wherein in each of said antenna arrays:

(a) there are just two of said antenna elements, with substantially equal dimensions;

(b) both of said antenna elements are connected to said associated electronic equipment; and (c) said means of connection to said associated electronic equipment also is such that the currents in corresponding conductors of said two antenna elements are approximately equal in amplitude and approximately 180 degrees out of phase with each other.

37. The antenna system of claim 35 wherein in each of said antenna arrays:

(a) there are just two of said antenna elements, with substantially equal dimensions;

(b) both of said antenna elements are connected to said associated electronic equipment;

(c) said means of connection to said associated electronic equipment also is such that the currents in corresponding conductors of said two antenna elements are approximately equal in amplitude; and (d) the distance between said antenna elements and the phase difference between said currents in said corresponding conductors are such that the radiation is minimized in one of the two directions perpendicular to said planes of said antenna elements.

38. The antenna system of claim 37 wherein in each of said antenna arrays:

(a) the distance between said antenna elements is approximately a free-space quarter wavelength of operation; and (b) the phase difference between said currents in said corresponding conductors is approximately a consistent 90 degrees.

39. The antenna system of claim 35 wherein in each of said antenna arrays:

(a) there are just two antenna elements in each of said antenna arrays;

(b) only the antenna element at the rear of said antenna arrays is connected to said associated electronic equipment; and (c) the dimensions of said antenna elements and the distances between said antenna elements are such that the transmitting and receiving ability is substantially unidirectional to the front of said antenna system.

40. The antenna system of claim 35 wherein:

(a) there is an even number of said antenna arrays in said antenna system;

(b) said antenna arrays are substantially the same as each other in the dimensions of their antenna elements and the distances between their antenna elements; and (c) a first half of said antenna arrays has its principal H planes oriented approximately perpendicular to said principal H planes of the remaining second half of said antenna arrays.

41. The antenna system of claim 40 wherein:

(a) said antenna arrays are disposed in pairs, each of said pairs comprising said antenna arrays having principal H planes of the two orientations;

(b) said antenna arrays also are disposed so that said proximal points of the corresponding antenna elements, in each of said pairs, are much closer to each other than the length of a wavelength of operation; and (c) said means of connection to said associated electronic equipment also is such that the currents in the conductors of said first half of said antenna arrays are approximately equal in amplitude and consistently out of phase by approximately 90 degrees to the currents in the corresponding conductors of said second half of said antenna arrays, thereby producing an approximately circularly polarized antenna system.

42. The antenna system of claim 40 wherein:

(a) said antenna arrays are disposed in pairs, each of said pairs comprising said antenna arrays having principal H planes of the two orientations;

(b) said proximal points of said antenna elements, in both of said antenna arrays in each of said pairs, are approximately aligned with each other;

(c) said means of connection to said associated electronic equipment also is such that the currents in corresponding conductors, in each of said pairs, are approximately equal in amplitude; and (d) the perpendicular distances between said planes of the corresponding antenna elements, in each of said pairs of said antenna arrays, and the phase relationship between the corresponding currents, in each of said pairs of antenna arrays, are such that approximately circularly polarized radiation is produced to the front of said antenna system.

43. The antenna system of claim 35 wherein:

(a) only the second antenna element from the rear of each of said antenna arrays is connected to said associated electronic equipment; and (b) in each of said antenna arrays, the dimensions of said antenna elements and the distances between said antenna elements are such that the transmitting and receiving ability is substantially unidirectional to the front of said antenna system.

44. The antenna system of claim 43 wherein the dimensions of said antenna elements and the distances between said antenna elements produce the maximum transmitting and receiving ability in the direction to the front of said antenna system.

45. The antenna system of claim 43 wherein the dimensions of said antenna elements and the distances between said antenna elements produce the minimum transmitting and receiving ability in directions other than in the direction to the front of said antenna system.

46. The antenna system of claim 43 wherein the dimensions of said antenna elements and the distances between said antenna elements produce a beneficial compromise between maximizing the transmitting and receiving ability in the direction to the front of said antenna system and minimizing said transmitting and receiving ability in other directions.

47. The antenna system of claim 35 wherein:

(a) the resonant frequencies of said antenna elements are progressively higher from the rear to the front of each of said antenna arrays;

(b) the distances between said antenna elements are progressively shorter from the rear to the front of each of said antenna arrays;

(c) within each of said antenna arrays, all of said antenna elements are connected to each other, effectively at said proximal points of said antenna elements, so that the phase relationship produced by the time taken for the energy to travel between said antenna elements, by that connection, is substantially equal to the phase relationship that is consistent with travel at the speed of light;

(d) said connection between said antenna elements also produces, in addition to the phase difference caused by the travelling time of the energy, an additional phase reversal between adjacent antenna elements; and (e) the antenna elements at the front of each of said antenna arrays are connected to said associated electronic equipment.

48. The antenna system of claim 47 wherein (a) the resonant frequencies of said antenna elements are proportionally higher from the rear to the front of each of said antenna arrays;

(b) the distances between said antenna elements are proportionally shorter from the rear to the front of each of said antenna arrays; and (c) within each of said antenna arrays, the ratio of said resonant frequencies of all the adjacent antenna elements and the ratio of all the adjacent distances between said antenna elements are approximately equal ratios.

49. The antenna system of claim 48 wherein the differences in said resonant frequencies are caused by all the dimensions of said antenna elements approximately being proportionally different.

50. The antenna system of claim 48 wherein:

(a) the heights of each of said antenna elements are all approximately equal; and (b) the differences in said resonant frequencies are caused by the widths of said antenna elements being different.

51. The antenna system of claim 48 wherein the method of producing said proportional resonant frequencies is a compromise between having all the dimensions of said antenna elements proportional to each other and having equal heights in each of said antenna elements.

52. An antenna array comprising at least one antenna element such that:

(a) each of said antenna elements comprises at least four approximately vertical conductors mounted at different points on an approximately horizontal conducting surface, such as the surface of the earth;

(b) said approximately vertical conductors are approximately aligned within a plane;

(c) between each adjacent pair of said approximately vertical conductors, pairs diagonal conductors extend within said plane from the tops of said approximately vertical conductors to meet each other approximately at said approximately horizontal conducting surface, but do not connect to said approximately horizontal conducting surface;

(d) the sum of the length of any one of said approximately vertical conductors and the length of any one of said diagonal conductors which is connected to said approximately vertical conductor is approximately between three-quarters of an operating wavelength and one operating wavelength; and (e) means is provided to connect at least one of said antenna elements to an associated electronic equipment effectively between the proximal point of said antenna element, approximately said approximately horizontal conducting surface, and an adjacent point on said approximately horizontal conducting surface.

53. The antenna array of claim 52, further including at least one radial conductor that extends approximately horizontally from the bottom of at least one of said vertical conductors.

54. The antenna array of claim 52, further including a reflecting screen disposed behind said antenna array to produce a substantially unidirectional transmitting and receiving ability to the front of said antenna array in the direction approximately perpendicular to said planes of said antenna elements.

55. The antenna array of claim 52 wherein there is only one of said antenna elements in said antenna array.

56. The antenna array of claim 52 wherein:

(a) there is more than one of said antenna elements in said antenna array;

(b) said antenna elements are disposed in planes approximately parallel to each other; and (c) said proximal points of said antenna elements are approximately aligned in the direction perpendicular to said planes of said antenna elements.

57. The antenna array of claim 56 wherein:

(a) there are just two of said antenna elements, with substantially equal dimensions;

(b) both of said antenna elements are connected to said associated electronic equipment; and (c) said means of connection to said associated electronic equipment also is such that the currents in corresponding conductors of said two antenna elements are approximately equal in amplitude and approximately 180 degrees out of phase with each other.

58. The antenna array of claim 56 wherein:

(a) there are just two of said antenna elements, with substantially equal dimensions;

(b) both of said antenna elements are connected to said associated electronic equipment;

(c) said means of connection to said associated electronic equipment also is such that the currents in corresponding conductors of said two antenna elements are approximately equal in amplitude; and (d) the distance between said antenna elements and the phase difference between said currents in said corresponding conductors are such that the radiation is minimized in one of the two directions perpendicular to said planes of said antenna elements.

59. The antenna array of claim 58 wherein:

(a) the distance between said antenna elements is approximately a free-space quarter wavelength of operation; and (b) the phase difference between said currents in said corresponding conductors is approximately a consistent 90 degrees.

60. The antenna array of claim 56 wherein:

(a) there are just two antenna elements in said antenna array;

(b) only the antenna element at the rear of said antenna array is connected to said associated electronic equipment; and (c) the dimensions of said antenna elements and the distances between said antenna elements are such that the transmitting and receiving ability is substantially unidirectional to the front of said antenna array.

61. The antenna array of claim 56 wherein:

(a) only the second antenna element from the rear of said antenna array is connected to said associated electronic equipment; and (b) the dimensions of said antenna elements and the distances between said antenna elements are such that the transmitting and receiving ability is substantially unidirectional to the front of said antenna array.

62. The antenna array of claim 61 wherein the dimensions of said antenna elements and the distances between said antenna elements produce the maximum transmitting and receiving ability in the direction to the front of said antenna array.

63. The antenna array of claim 61 wherein the dimensions of said antenna elements and the distances between said antenna elements produce the minimum transmitting and receiving ability in directions other than in the direction to the front of said antenna array.

64. The antenna array of claim 61 wherein the dimensions of said antenna elements and the distances between said antenna elements produce a beneficial compromise between maximizing the transmitting and receiving ability in the direction to the front of said antenna array and minimizing said transmitting and receiving ability in other directions.

65. The antenna array of claim 56 wherein:

(a) the resonant frequencies of said antenna elements are progressively higher from the rear to the front of said antenna array;

(b) the distances between said antenna elements are progressively shorter from the rear to the front of said antenna array;

(c) all of said antenna elements are connected to each other, effectively at said proximal points of said antenna elements approximately at said approximately horizontal conducting surface, so that the phase relationship produced by the time taken for the energy to travel between said antenna elements, by that connection, is substantially equal to the phase relationship that is consistent with travel at the speed of light;

(d) said connection between said antenna elements also produces, in addition to the phase difference caused by the travelling time of the energy, an additional phase reversal between adjacent antenna elements; and (e) the antenna element at the front of said antenna array is connected to said associated electronic equipment.

66. The antenna array of claim 65 wherein (a) said resonant frequencies of said antenna elements are proportionally higher from the rear to the front of said antenna array;

(b) said distances between said antenna elements are proportionally shorter from the rear to the front of said antenna array; and (c) the ratio of said resonant frequencies of all the pairs of adjacent antenna elements and the ratio of all the pairs of adjacent distances between said antenna elements are approximately equal ratios.

67. The antenna array of claim 66 wherein the differences in said resonant frequencies are caused by all the dimensions of said antenna elements approximately being proportionally different.

68. The antenna array of claim 66 wherein:

(a) the distances, in the planes of said antenna elements, between the corresponding vertical conductors of all of said antenna elements, are approximately equal; and (b) the differences in said resonant frequencies are caused by the heights of said vertical conductors being different.

69. The antenna array of claim 66 wherein the method of producing said proportional resonant frequencies is a compromise between having all the dimensions of said antenna elements proportional to each other and having equal distances, in the planes of said antenna elements, between the corresponding vertical conductors.

* * * * *